US009919202B2

(12) United States Patent
Popadiuk, Jr.

(10) Patent No.: US 9,919,202 B2
(45) Date of Patent: Mar. 20, 2018

(54) PINBALL GAME TRUSS SYSTEM

(71) Applicant: John A. Popadiuk, Jr., Bartlett, IL (US)

(72) Inventor: John A. Popadiuk, Jr., Bartlett, IL (US)

( * ) Notice: Subject to any disclaimer, the term of this patent is extended or adjusted under 35 U.S.C. 154(b) by 582 days.

(21) Appl. No.: 14/503,782

(22) Filed: Oct. 1, 2014

(65) Prior Publication Data

US 2015/0091250 A1 Apr. 2, 2015

Related U.S. Application Data

(60) Provisional application No. 61/885,639, filed on Oct. 2, 2013.

(51) Int. Cl.

| | |
|---|---|
| ***A63F 7/02*** | (2006.01) |
| ***A63F 7/36*** | (2006.01) |
| *A63F 9/24* | (2006.01) |

(52) U.S. Cl.

CPC ..... *A63F 7/025* (2013.01); *A63F 7/027* (2013.01); *A63F 7/36* (2013.01); *A63F 2009/248* (2013.01); *A63F 2009/2451* (2013.01); *A63F 2009/2457* (2013.01); *A63F 2009/2482* (2013.01)

(58) Field of Classification Search

CPC .. A63F 7/027; A63F 7/36; A63F 7/025; A63F 2009/2451; A63F 2009/248; A63F 2009/2482; A63F 2009/2457

See application file for complete search history.

(56) References Cited

U.S. PATENT DOCUMENTS

| | | | | |
|---|---|---|---|---|
| 3,882,650 | A * | 5/1975 | Gugliotta | E04B 1/1906 403/176 |
| 6,581,931 | B1 * | 6/2003 | Doepner | A63H 30/04 273/118 A |
| 2005/0123346 | A1 * | 6/2005 | Nakamura | F16B 7/0406 403/348 |
| 2011/0115155 | A1 * | 5/2011 | Frontiero, Jr. | A63F 7/027 273/118 A |
| 2014/0091519 | A1 * | 4/2014 | Gomez | A63F 7/36 273/121 R |

OTHER PUBLICATIONS https://web.archive.org/web/20030405043620/http://superdairyboy.com/constructiontoys/knex.html, Apr. 5, 2003, pp. 1-2.* https://web.archive.org/web/20030501000000*/http://www.superdairyboy.com/constructiontoys/knex.html, retrieved on Apr. 10, 2007.*

K'Nex Electronic Arcade Pinball Machine Review and Play from 2002!, published on Feb. 2, 2015 https://www.youtube.com/watch?v=ddavDkhGVSc, p. 1.*

* cited by examiner

*Primary Examiner* — Jasson Yoo

(74) *Attorney, Agent, or Firm* — Brown & Michaels, PC

(57) ABSTRACT

A modular pinball game truss system provides for lighting and other pinball game features, such as targets, ramps, ball pathways, bumpers, and ball-reactive game or decorative elements, features that move, make sounds, flash, display score, register points, illuminate, or otherwise react to a given pinball movement, to be easily added to existing games and changed at any time by individual game owners.

19 Claims, 29 Drawing Sheets

PINBALL GAME TRUSS SYSTEM

REFERENCE TO RELATED APPLICATIONS

This application claims one or more inventions which were disclosed in Provisional Application No. 61/885,639, filed Oct. 2, 2013, entitled "Pinball Game Truss System". The benefit under 35 USC § 119(e) of the United States provisional application is hereby claimed, and the aforementioned application is hereby incorporated herein by reference.

BACKGROUND OF THE INVENTION

Field of the Invention

The invention pertains to the field of pinball game machines. More particularly, the invention pertains to pinball game playfield construction, scoring and lighting features.

Description of Related Art

A typical pinball machine includes a wooden pinball game playfield with various pinball game features such as bumpers, rails, ramps, sling shots, and a wide array of other types of mechanical, electrical, electronic, and electro-mechanical features affixed to it, creating a playable game according to scoring rule sets programmed into the game control system as a pinball activates various game features. In the prior art, pinball game features such as bumpers, posts, solenoids, ramps, magnets, mechanical obstacles, light bulbs, sockets and other types of pinball game features are not designed to be relocated, adjusted or customized in any significant fashion.

Because the game of pinball is typically housed in a wooden cabinet and designed with a wide variety of light bulbs interspersed about a planar pinball game playfield, the pinball game playfield can appear dark and unappealing in some areas. Typically, the lights used on a pinball game playfield in the prior art have been conventional incandescent miniature lamps. More recently, LEDs that produce a high intensity vibrant localized illumination have been adapted to use the same miniature lamp sockets historically used in pinball games, and this has inspired many owners and commercial operators to customize their own games using colored lamps or LEDs that were not part of the standard pinball game.

Additionally, many lamps, whether conventional or LED, are needed to illuminate a pinball game. Elevated secondary playfield levels and raised ball paths, such as ramps and rail tracks, generally remain out of the illumination path and appear dark and unappealing as a result. Additionally, in some cases poor lighting conditions may make it difficult for the player to identify the ball position, especially during high speed play. Static mounted sockets are sometimes used in an elevated position to illuminate some of these elevated areas. However, this is generally a poor solution that does little to enhance game play, and is little more than a spot solution in most cases that cannot be adjusted by the game owner.

As with lighting, other pinball game features are similarly fixed in their position and offer, if any, only small standardized opportunities for adjustments, tweaks, and alterations to improve gameplay. For example, some posts may be relocated a small distance or sensitivity of some switches can be adjusted. As pinball has become a popular hobby and a professional sport internationally, both private collectors and commercial operators have been desirous of customizing their individual pinball games to reflect their own play style, add their own twist to the game, or simply personalize their game. Such customizations are particularly desired by private collectors who, over time, may become bored with a single machine in their collection. In the professional arena, customization would present players with new challenges they would only face on tournament play pinball games.

Unfortunately, adding new features, lighting, electromechanical and robotic devices, or alternate illumination cannot even be considered beyond simple conventional lamp to LED changes, lamp color changes, and in some cases the addition of static decorative figurines or other merely ornamental game features.

SUMMARY OF THE INVENTION

A modular pinball game truss system provides for lighting and other pinball game features, such as ramps, targets, ball pathways, bumpers, and ball-reactive or decorative game elements, features that move, make sounds, flash, display score, register points, illuminate, or otherwise react to a given linear pinball input or movement, to be easily designed new and/or be added to existing games and changed at any time by individual game owners.

DETAILED DESCRIPTION OF THE INVENTION

A modular pinball game truss system provides for lighting and other pinball game features such as targets, ramps, ball pathways, bumpers, and ball-reactive game or decorative elements, for example, features that move, make sounds, flash, display score, register points, illuminate, or otherwise react to a given pinball movement, to be easily added to games and changed at any time by individual game owners. This permits retrofitting and personalized customization of any existing pinball game. Any of the elements described herein could alternatively be included during the manufacturing of a new pinball machine.

In one embodiment, the basis of this truss system is a standardized set of component interfaces, truss with structural and/or conductive elements, support post elements, and attachment module elements designed to be universally compatible with each other, as well as pinball game playfield attachment points. This truss system may be integrated into new pinball game designs in some embodiments, and easily adapted to existing electro-mechanical, solid-state, and processor controlled pinball machines in other embodiments. As a result, game owners may completely customize their games, new and old, at any time they desire, by repositioning trusses, adding new trusses in different locations over the pinball game playfield, and adding, removing, or relocating interactive pinball game features, magnets, lights or other pinball-centric components such as targets, ramps, upper level playfields and others to the truss structures.

Figure 1:
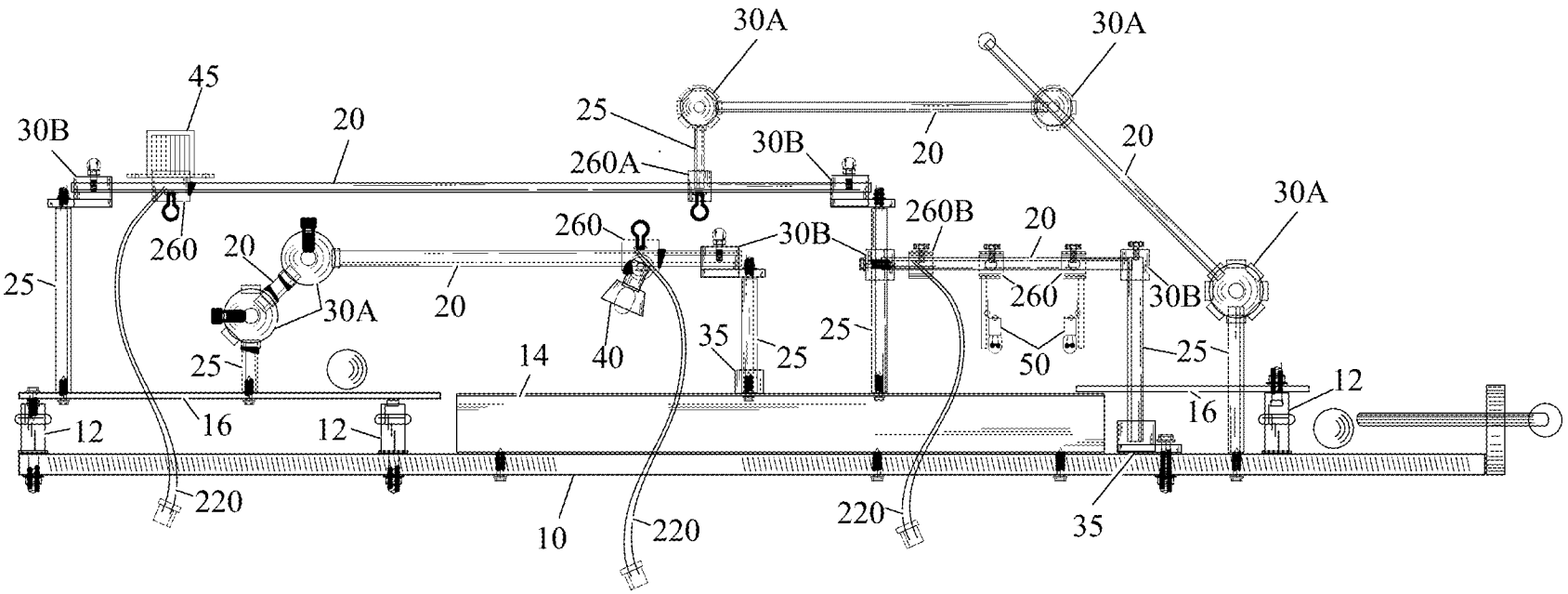
FIG. 1 shows a side view of the elements of a pinball truss system arranged on a pinball game playfield in an embodiment of the present invention.

Referring now to FIG. 1, a truss system is shown installed over a pinball game playfield 10 including known surface mounted components including, but not limited to, game posts 12, side rails 14, decorative plastics 16 and others. In one embodiment, the truss system elements include truss structural elements 20 of various lengths, truss posts 25 of various lengths, and truss connector blocks 30A, 30B connecting truss structural elements 20 to each other and to truss posts 25. In some embodiments, truss connector blocks 30A, 30B of various shapes form two perpendicular sockets. A first socket is formed to accept a truss post 25, and as shown in FIG. 1, a second socket is formed to accept one or more truss structural elements 20. Truss posts 25 and truss structural elements 20 may be secured into truss connector blocks 30A, 30B with set screws or other removable fasteners, for example.

Additionally, single aperture attachment modules 260 are shown connecting pinball game features such as lamps with diffusers 45, conventional lamps 50, and spot lights 40, for example, to truss structural elements 20. Attachment modules 260, 260B are in some embodiments adapted to bring power and control signals to the truss system, and pinball game features attached to attachment modules 260 through conventional wiring 220. In other embodiments, attachment modules 260A are adapted to connect truss posts 25 to truss structural elements 20.

Truss posts 25 of the truss system may be constructed in various lengths and shapes, or made generically to be cut to any desired length, and added above a conventional pinball game feature or the pinball game playfield 10. In some embodiments, these truss posts 25 are hollow and held in place, for example, using a screw of appropriate length to replace a shorter screw originally used to hold an existing pinball game feature, such as an existing game post 12 supporting a decorative plastic 16.

Truss posts 25 of the truss system may also be added to the existing game side rails 14 with post sockets 35, where their attachment will not permanently damage the pinball game playfield 10. In some embodiments, a post socket 35 is attached to a side rail 14 by a screw passing through the center of the socket. In other embodiments, a post socket 35 is constructed as a socket with a flange through which a screw passes to hold the post socket 35 to the pinball game playfield 10, or other pinball game feature or structure. Post sockets 35 may connect truss posts 25 to the pinball game playfield 10, and pinball game playfield side rails 14, for example, or directly to existing pinball game features.

In some embodiments, the truss posts 25 include internal threads that mate to threaded studs known in the art to mount truss posts 25 to existing conventional pinball game features, such as game posts 12 supporting decorative plastic covers 16, to the pinball game playfield 10 with the truss posts 25 replacing cap nuts or other fasteners threaded to existing threaded studs. This description should not be considered limiting of the truss system, and truss posts 25 of various lengths may be similarly affixed at multiple locations above the pinball game playfield 10 to support multiple truss structural elements 20. Further, although simple truss posts 25 are shown, it is understood that a truss post 25 may be formed in a wide variety of shapes and sizes, including plates, simulated girders, and other forms. Similarly, the truss post 25 may be mounted to the pinball game playfield 10 in a variety of other fashions, including, but not limited to, simple screws through "L" brackets at the end of the post forming a mount, pop-bumper covers that have sockets to receive one end of a truss post 25, and other forms of sockets attached to the pinball game playfield 10 or other pinball game playfield 10 elements that may receive a truss post 25.

In one embodiment, the truss structural elements 20 are powered. Power for the truss structural elements 20 may be supplied by existing pinball game power busses, or additional power supplies provided as an optional component of the truss system. In other embodiments, the truss structural elements 20 are unpowered and rely on conventional wiring 220 to supply power and/or control signals to the pinball game features attached to the truss structural elements 20, to attachment modules 260, or directly to pinball game features attached to the attachment modules 260.

Having installed one or more such truss structural elements 20 above a pinball game playfield 10, a wide variety of pinball game features and lighting may thus be added, relocated, or removed at any time and made operational with pinball game features, including, but not limited to, spot lights 40, flashers 45, conventional lamps 50, motors, and/or other electrical and electronic components.

Figure 2A:
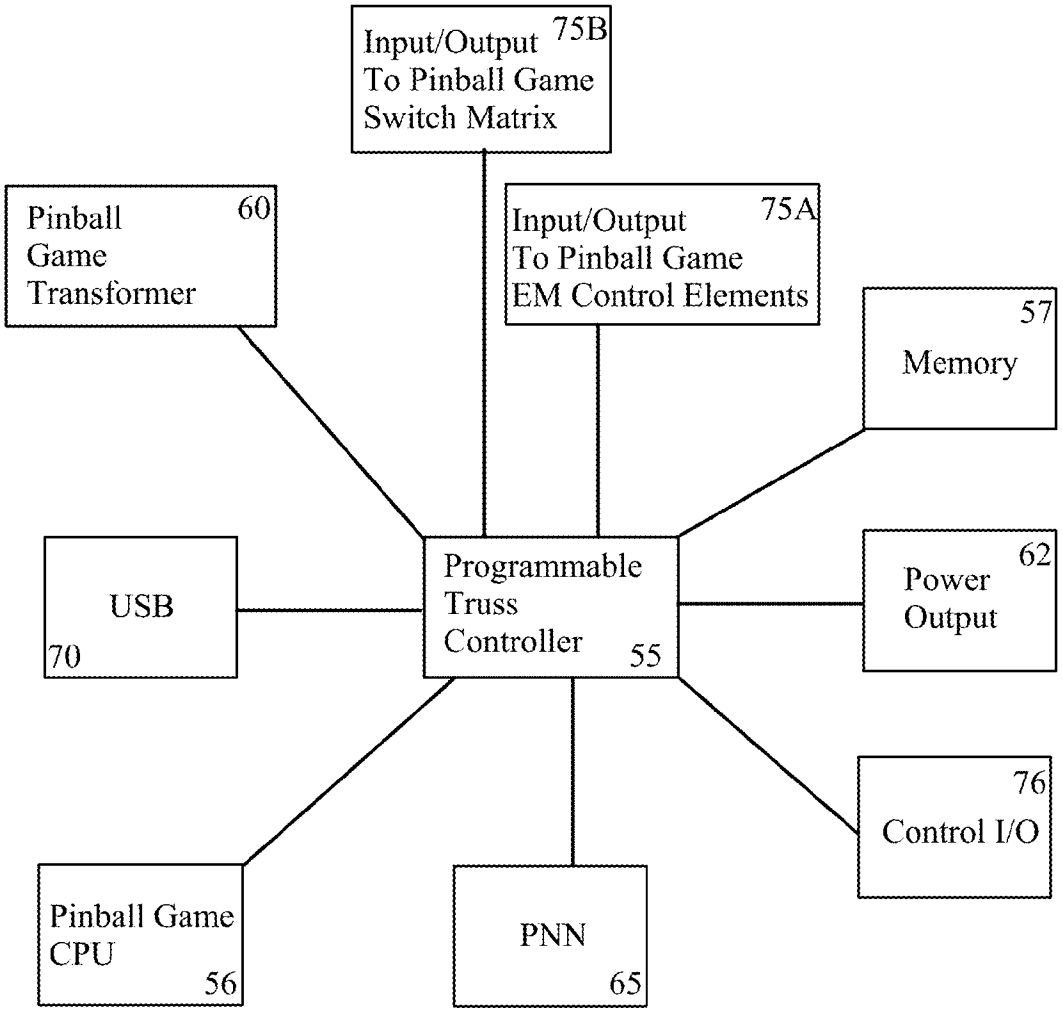
FIG. 2A shows a block diagram of a pinball truss system controller with exemplary input and output interfaces.

In some embodiments, shown in FIG. 2A, the truss system includes a programmable truss controller 55 that is secured at any convenient location within the pinball game cabinet, typically under the play field or in the game "head" unit. The programmable truss controller 55 may be connected to the standard game power transformer 60 for power and thus also provide outputs 62 for power to, for example, truss structural elements 20, individual truss-mounted pinball game features, and lamps 40, 45, 50 mounted on the truss structural elements 20, or directly to these elements 20, 40, 45, 50 through conventional cable or wiring 220.

In some embodiments, the pinball game computer processing unit (CPU) 56 controls the truss structural elements 20 or programmable truss controller 55. In these embodiments, the truss system is preferably controlled by the pinball game CPU 56 directly. Embedded micro-controllers in the truss structural elements 20 may also handle some control and command functions. The programmable truss controller 55 in some embodiments is pre-programmed and completely dedicated to the truss system.

The programmable truss controller 55 also preferably provides one or more inputs and outputs each servicing a programmable node network (PNN) 65. Through each PNN, features added to the truss system or wired directly to the truss controller 55 and having appropriate addressable circuitry known in the art may be recognized and controlled independently or together in groups or series as desired from a single bus.

The programmable truss controller 55 may have executable code stored in a non-transient computer readable memory 57 that detects when a given feature on the truss system has been activated. The programmable truss controller 55 may be programmed to execute a response to such triggering. These responses include, but are not limited to, causing lights 45, 50 to turn on/off or flash, activating motors contained in a pinball game feature that has been activated, or in another feature on the truss system, and other functions associated with each pinball game feature mounted on a truss structural element 20.

The programmable truss controller 55 may also be provided with a Universal Serial Bus (USB) 70 or other external computer interface that allows the game owner or manufacturer to program the programmable truss controller 55, upload feature specific software control modules, define rule sets that determine how various pinball game features attached to the truss system interact with each other and other pinball game features, what score value may be applied to the activation of an interactive pinball game feature attached to the truss system, and other similar control functions.

The programmable truss controller 55 may also be provided with inputs/outputs to a standard game scoring system already installed in a pinball game. In one embodiment, a plurality of inputs/outputs 75A are provided that interface with various scoring relays and other electro-mechanical (EM) control elements of the pinball game. In another embodiment, inputs/outputs 75B are connected to scoring matrix pins of a solid state or processor based game controller in a pinball game, to simulate activation of conventional existing pinball game features in order to register scores from pinball game features mounted on the truss system.

The programmable truss controller 55 is also preferably provided with a direct control input/output 76 to deliver a variety of control signals directly to the truss structural elements 20, pinball game feature attached to the truss system, or other truss system elements.

In new pinball game constructions, the programmable truss controller 55 architecture and PNN 65 interface may be integrated directly into the main game control system (CPU) 56, or additional programmable truss controller 55 controller boards may be added to the main game control system (CPU) 56, to allow complete user customization of the pinball game, including, but not limited to, scoring and rule sets associated with pinball game features mounted on the truss system.

Two conductive truss structural elements 20 are used in some embodiments, as shown in FIG. 2E and FIGS. 6-8, with control signals superimposed over power conductive truss structural elements 20 forming the truss. In alternate embodiments, shown in FIG. 3, multiple conductive truss structural elements 20 form the truss and provide, for example, for power +, ground G, clock timing CLOCK, and control signals DATA. This configuration should not to be considered limiting of the truss system in any way, as a variety of programmable bus structures using different numbers of conducting truss structural elements 20, or combinations of conducting and non-conducting truss structural elements 20, are within the scope of the truss system 20 described herein.

Figure 2B:
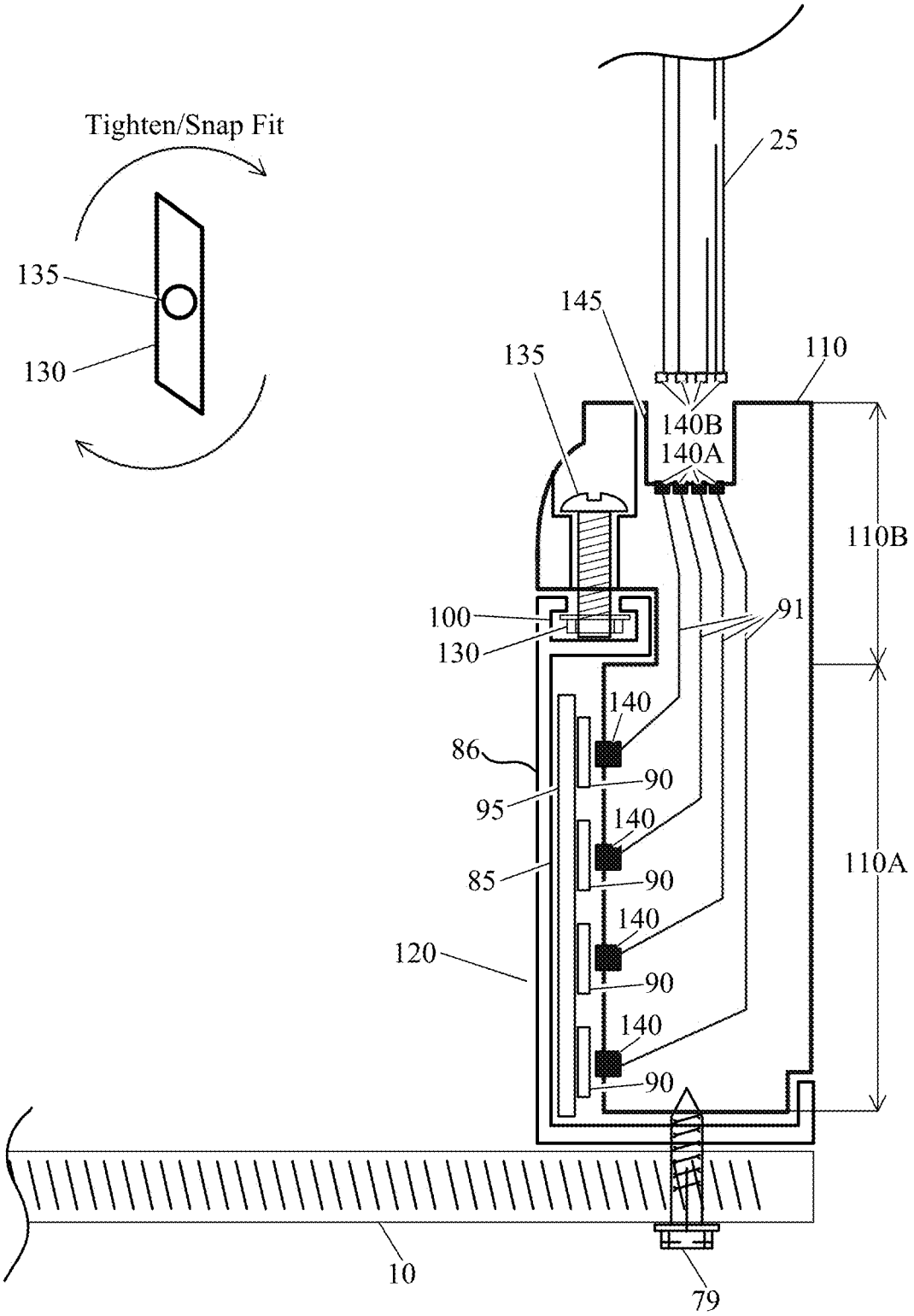
FIG. 2B shows a cross-sectional view of an embodiment of a mounting bus "C"-channel pinball game playfield side rail and an associated bus connector.
Figure 2C:
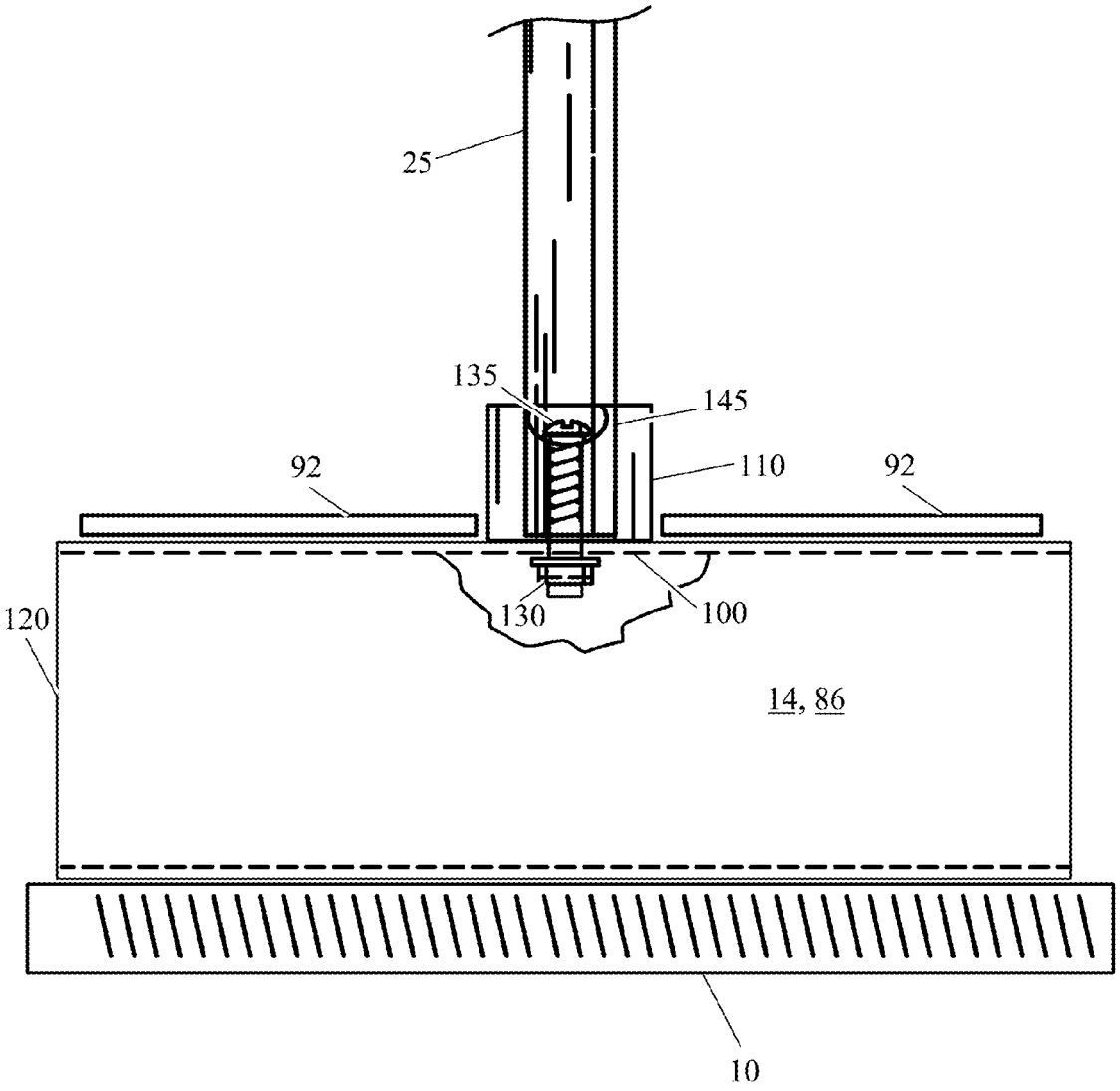
FIG. 2C shows a partial cut-away view of an embodiment of a mounting bus "C"-channel pinball game playfield side rail and an associated connector.

In one embodiment, shown in FIG. 2B and FIG. 2C, in addition to the post mounting structures previously described herein, a universal mounting bus 120 is provided in lieu of, or in addition to, conventional pinball game playfield side rails 14, and affixed to the pinball game playfield 10 or an existing side rail 14 by any means known in the art, including, but not limited to, screws 79, mating channels, adhesives, and rivets.

Referring to FIG. 2B, at least a first channel 85 forms the basic structure of the universal mounting bus 120. In one embodiment, this first channel 85 is produced as an extrusion, for example, of plastic, metal, or other suitable structural material. A game facing portion 86 of the first channel 85 is oriented toward the pinball game playfield 10 creating a side rail 14, or a vertical extension of an existing side rail 14. Conductors 90 are arranged parallel to the first channel 85 on an inner surface of the first channel 85, with printed circuit board substrates 95 and/or insulators, for example, intervening between the conductors 90 and the first channel 85 as necessary depending on the conductivity of the first channel 85 material of construction.

An upper portion of the universal mounting bus 120 may optionally form a horizontally oriented second channel 100 to which truss system elements may be affixed. This second channel 100 may accept fasteners 130 along its length that are either directly inserted in a slot at the top of the channel 100, or inserted into an open end of the channel 100 when the pinball game playfield 10 is raised above the level of the game cabinet.

A mating bus connector 110, also shown in FIG. 2B, may be placed at any location along the length of the universal mounting bus 120. A first portion 110A of the mating bus connector 110 preferably fits inside the first channel 85, and a second portion 110B communicates around and above the second channel 100 as shown. One or more screws 135 are preferably placed through threaded fasteners 130 so that a first portion 110A of the mating bus connector 110 is held by the first channel 85 when the screw 135 is tightened, and also holds a second portion 110B of the mating bus connector 110 firmly clamped to the second channel 100.

In some embodiments, the threaded fasteners 130 are conventional threaded nuts, or elongated pucks that are narrow enough in one dimension to be inserted into the second channel 100 from above when threaded to a screw. Tightening of the screw 135 then causes the elongated puck to rotate and engage the second channel 100, stopping its rotation so that the screw 135 may be tightened. In other embodiments, snap-fit or friction fit fasteners are formed with wedged wings which are inserted into the second channel 100 in one orientation, with the wedged wings firmly engaging the second channel 100. Alternative fasteners include, but are not limited to, "T"-head bolts fitted to the second channel 100 with nuts holding the mating bus connector 110 from above.

The mating bus connector 110 may also include contacts 140 that mate with conductors 90 on an inner surface of the first channel 85. Appropriate conductors 91 may be incorporated directly into a casting or injection molding of the mating bus connector 110, or the mating bus connector 110 may be formed with channels to accept conductors 91 and direct them from the contacts 140 of the mating bus connector 110 to a location, such as a socket 145, where they may be connected to a truss post 25 or a pinball game feature, for example, by mating contacts 140A and 140B.

The mating bus connector 110 is preferably formed with sockets 145 to accept truss posts 25, electrical sockets that communicate power and control signals to truss structural elements 20 or pinball game features mounted on truss structural elements 20, or other similar mounting and interface points. In some embodiments, the mating bus connector 110 is formed of injection molded plastic, cast plastics, pot metal, or other suitable materials.

FIG. 2C shows a different view of the universal mounting bus 120 with a partial cut away showing a threaded fastener 130 holding a screw 135 in the second channel 100. Filler strips 92 may be cut to length and inserted into the second channel 100 between adjacent pairs of mating bus connectors 110 installed in the universal mounting bus 120. Thus, the customized game attains a professional appearance after customization. FIG. 2C also shows the mating bus connector 110 having a post socket 145 with a truss post 25.

Figure 2D:
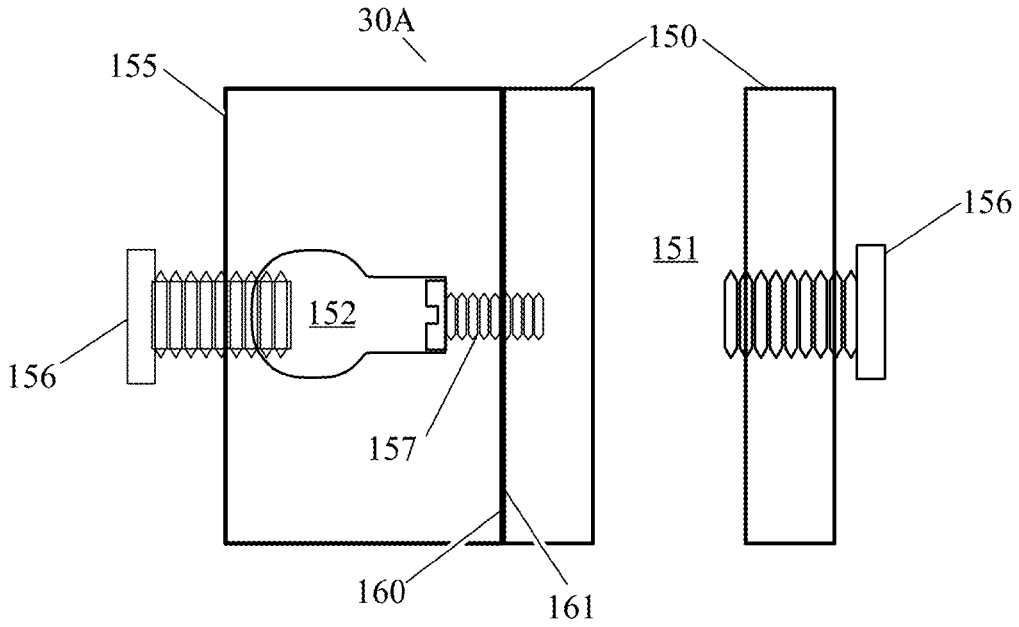
FIG. 2D shows an embodiment of a truss connector block including a post collar and a truss collar.
Figure 2E:
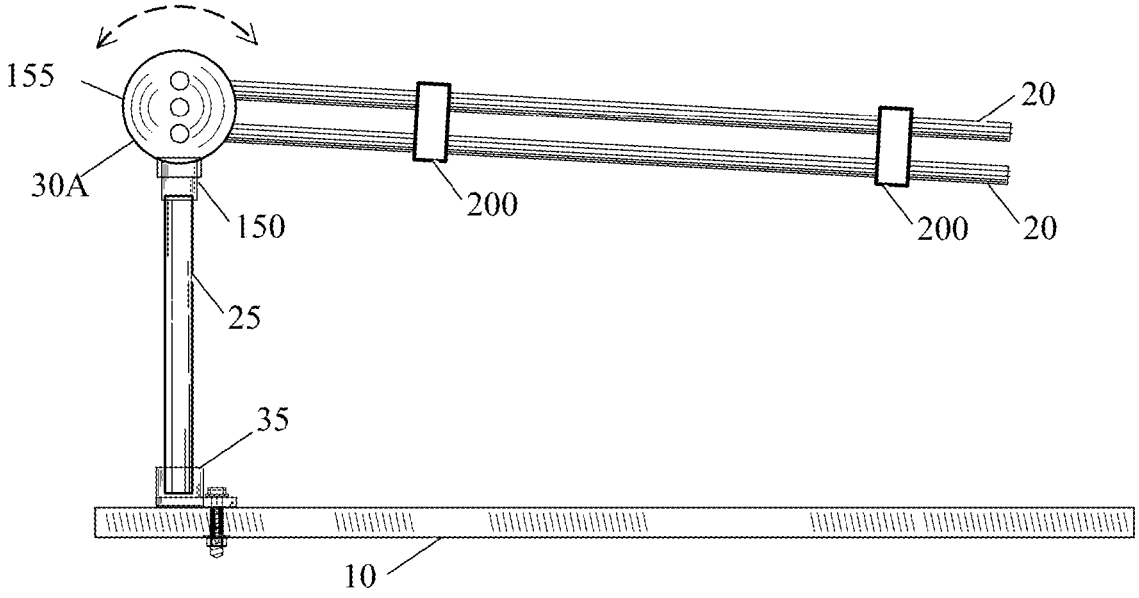
FIG. 2E shows a side view of an embodiment of a truss connector block, post, and post collar connected to a post mount attached to a pinball game playfield.

In some embodiments, truss posts 25 are connected to truss structural elements 20 via truss connector blocks 30A of a type shown in FIG. 2D and FIG. 2E. In one embodiment, the truss connector block 30A includes a post collar 150 and a truss collar 155. As shown FIG. 2D, the post collar 150 defines an aperture 151 that accepts a truss post 25 and a thumb screw 156 that tightens on a truss post 25, holding the post collar 150 at a desired height and orientation on the truss post 25. The truss collar 155 defines one or more apertures 152 to accept truss structural elements 20, and similarly has one or more thumb screws 156 that may be tightened to hold truss structural elements 20. The truss collar 155 shown in FIG. 2D has one aperture 152 that accepts single truss structural elements 20, however, any number of apertures 152 may be incorporated to accept multiple truss structural elements 20, truss posts, 25, or other truss system elements.

FIG. 2E shows a truss connector block 30A including a truss collar 155 having two apertures 152 to accept two truss structural elements 20. However, the truss collar 155 may be adapted to accept any configuration of truss structural elements 20. Similarly, although the truss collar 155 is shown with a thumb screw 156 in FIG. 2D to stabilize truss structural elements 20, other truss collar 155 configurations are possible, such as snap fit designs that either directly mate with the truss structural elements 20, or mate with truss posts 25, tabs, truss spacers 200, or other elements of the truss structural elements 20.

In FIG. 2D, the post collar 150 and the truss collar 155 are connected by a set screw 157 that, when loosened, allows the truss collar 155 to rotate relative to the post collar 150 and facilitates various truss structural element 20 angulations, indicated by the dotted arrows in FIG. 2E. This set screw 157 may be accessed by removing the truss collar thumb screw 156, or the thumb screw 156 may be placed at an alternate location and the set screw 157 accessed by an alternate aperture in the truss collar 155 or post collar 150.

The mating surfaces 160, 161 of the truss collar 155 and the post collar 150, respectively, are shown as simple planar surfaces in FIG. 2D. However, other geometries are possible such as mating cylindrical grooves and protrusions on each surface 160, 161 that fit to one another and allow the truss collar 155 to rotate in relation to the post collar 150. Serrations or other surface features may be incorporated into the mating surfaces 160, 161 to assist in fixing the relation between the post collar 150 and the truss collar 155 when the set screw 157 is tightened. While a set screw 157 is shown connecting the truss collar 155 and post collar 150, other fixation methods may be used such as post collars 150 and the truss collars 155 that snap together in multiple orientations, snap fit protrusions and apertures connecting post collars 150 and the truss collars 155, fixed orientation post collars 150 and the truss collars 155 as a unitary construction, and other similar types of connectors.

Further, although the truss collar 155 and post collar 150 have been discussed in relation to each other, it is understood that either of these elements 150, 155 may be modified with tabs, threaded holes, or other modifications that facilitate their use singly to attach truss posts 25 to pinball game playfields 10, for example, or in pairs of the same type to allow truss posts 25 to be connected to other truss posts 25, and truss structural elements 20 to be connected to other truss structural elements 20 without deviating from the modular structure that the truss system truss collar 155 and post collar 150 structure described herein.

Referring back to FIG. 1, alternate truss connector blocks 30B are shown connecting truss structural elements 20 to truss posts 25. In one embodiment, the truss connector block 30B includes a socket with a tab. The tab may be affixed to a truss post 25 with a screw or other fastener, for example, and one or more sockets may be incorporated to accept one or more truss structural elements 20. Alternatively, the connector block 30B includes a first set of sockets accepting one or more truss structural elements 20, and a second set of sockets accepting one or more posts 25, or other truss structural elements 20. In other embodiments, the two sets of sockets are arranged with a fixed angulation between them, or with a variable angulation as previously described in relation to the connector block 30A.

Figure 3:
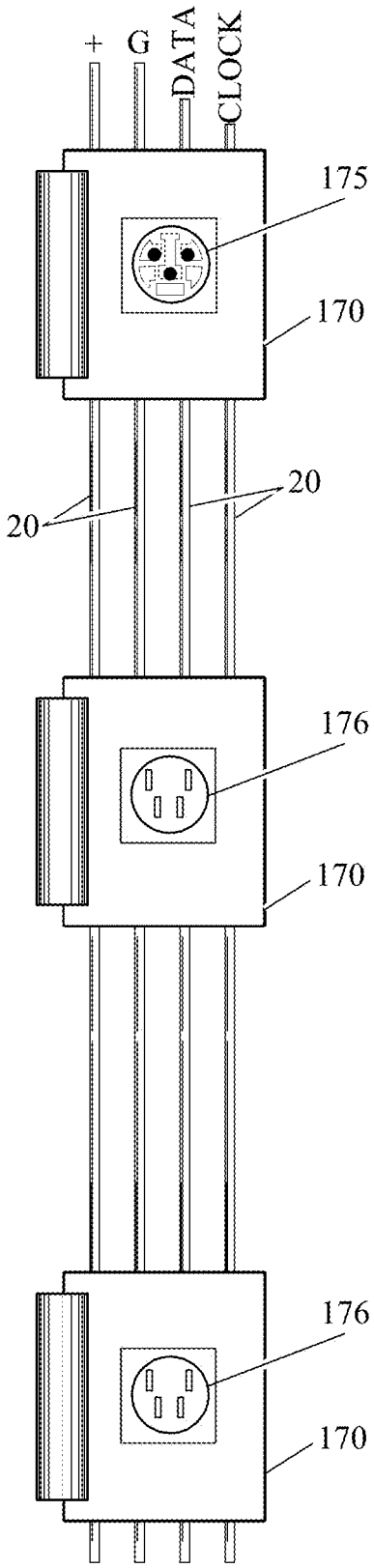
FIG. 3 shows one embodiment of a series of attachment modules affixed to a conductive four rail structural element truss.
Figure 4:
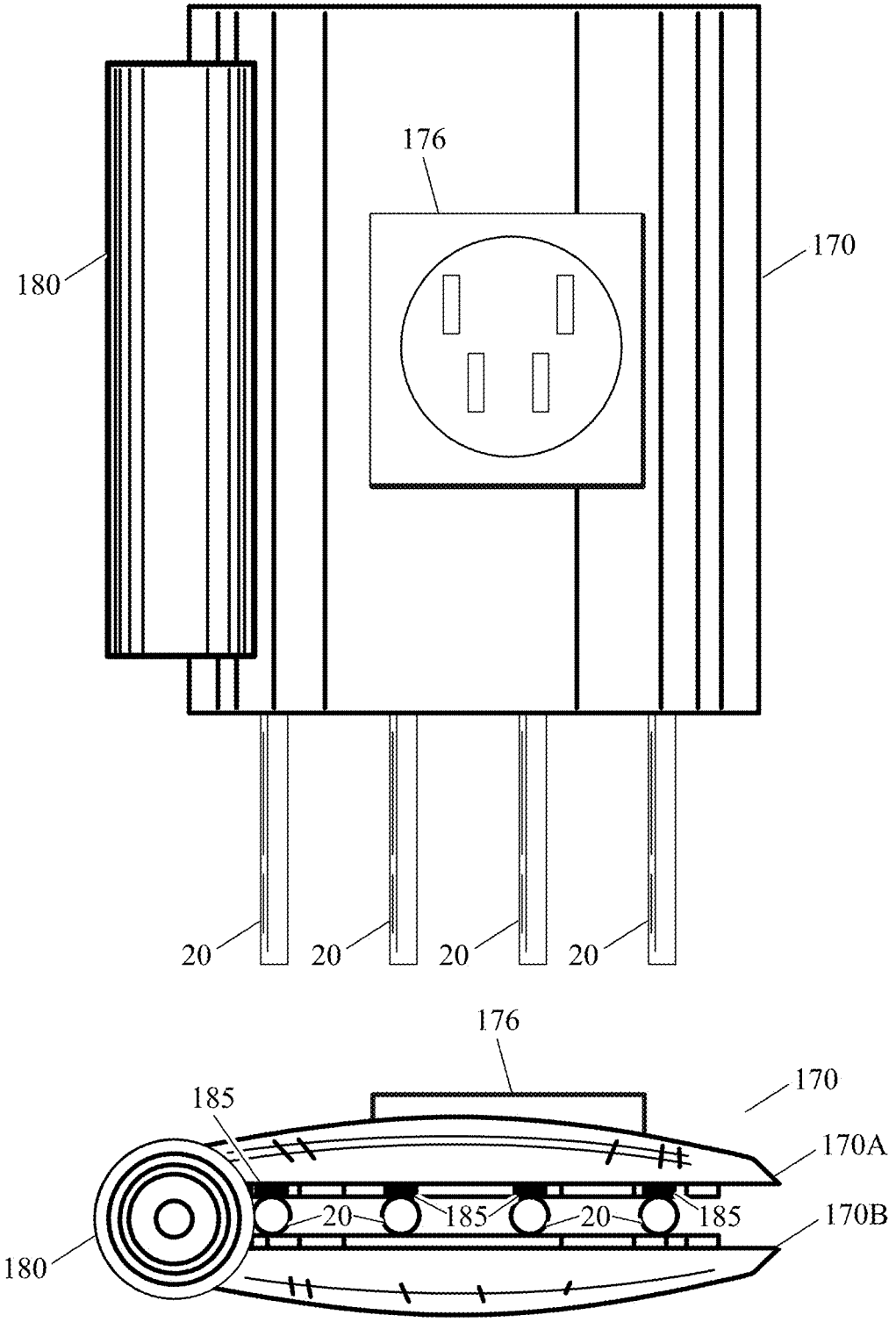
FIG. 4 shows a detail of an attachment module shown in FIG. 3.

A feature attachment module 170 is shown in FIG. 3 and in greater detail in FIG. 4. In one embodiment, the attachment module 170 grips one or more truss structural elements 20, and includes contacts that communicate to a standardized socket 176 that may mate with a mating plug attached to a pinball game feature. In another embodiment, four truss structural elements 20 are shown in conjunction with an attachment module 170 including a three color RGB LED 175, or other pinball game feature, that is permanently attached to the attachment module 170. This RGB LED 175 is shown for illustrative purposes only, as any type of pinball game feature may be incorporated into the attachment module 170. Alternatively, the standardized socket 176, which allows attachment of a variety of electrical and electronic pinball game features, is integrated into the attachment module 170.

Attachment modules 170 of a varying number of conductors and standardized socket 176 configurations lie within the scope of the truss system described herein. In the examples shown in FIGS. 3-4, the attachment module 170 is spring loaded 180 so that a first half 170A of the attachment module 170 and a second half 170B clamp on the truss structural elements 20. However, the attachment module 170 may also include a snap lock design, or utilize other appropriate closure structures to ensure that the attachment module 170 firmly grips the truss structural elements 20, and maintains reliable electrical contact between conducting truss structural elements 20, and contacts 185 contained in the attachment module 170.

Figure 5:
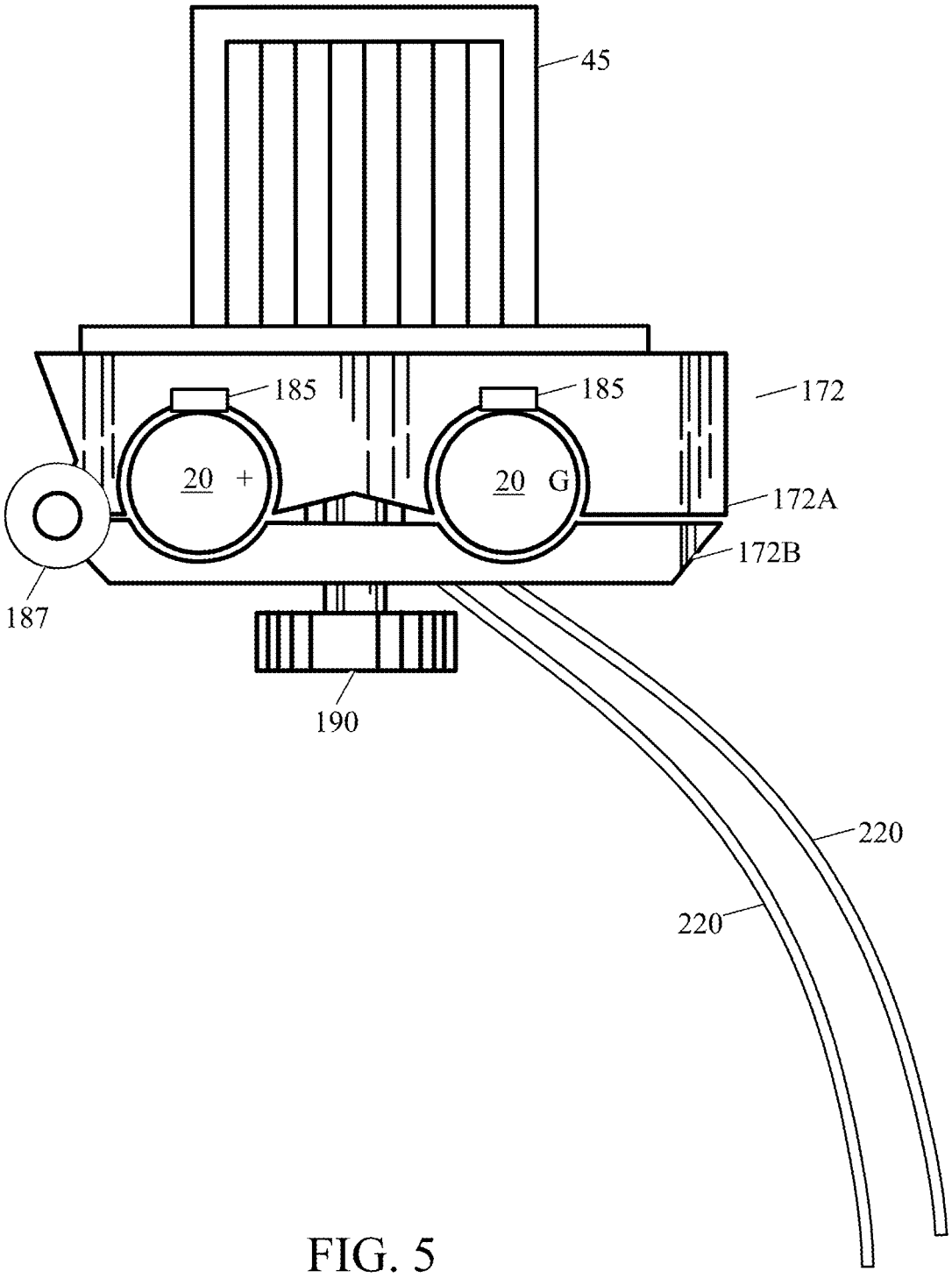
FIG. 5 shows an alternate embodiment of an attachment module affixed to a conductive two rail structural element truss.

FIG. 5 shows an alternative embodiment of an attachment module 172 using a hinge 187 connecting two halves 172A, 172B of the attachment module 172, and secured with a thumb screw 190 to two conducting truss structural elements 20 providing power + and ground G. Appropriate contacts 185 are also included in the attachment module 172 to drive a pinball game feature attached to the attachment module 172 as needed. In this example, a cylindrical lamp diffuser 45 covering a lamp or LED is shown that derives power and control from the conducting truss structural elements 20, or may optionally have independent wiring 220 that is connected to remote power points, or provide power and control signals to a second pinball game feature in proximity to the cylindrical lamp diffuser 45 shown.

Two conducting truss structural elements 20 are shown in FIG. 5, in which the conducting truss structural elements 20 include a power conductor + and a ground conductor G, separated at intervals by non-conducting truss spacers 200, as previously described and shown in FIG. 2E. These truss spacers 200 may be slidably attached through snap fit channels formed in the truss spacers 200 that grip the conducting truss structural elements 20, allowing the truss spacers 200 to be moved or eliminated as needed in constructing a truss system of a desired architecture. As shown in FIG. 21B, truss spacers 200 may also be fitted with contacts and conventional wiring 220 to also provide power and control signals to the conducting truss structural elements 20 they are affixed to from remote points, or to transfer power and control to or from another set of conducting truss structural elements 20, for example.

While four conductive truss structural elements 20 are shown in FIG. 4 and two conductive truss structural elements 20 are shown in FIG. 5, these are examples only, and any number of conductive truss structural elements 20 may be alternatively used. For example, any number of conductive truss structural elements may be required, with associated conductors throughout the truss system or independent of the truss system, for RGB LED 175 control, connection to a programmable truss controller 55, connection to a PNN 65, connection to other truss structural elements 20, as required by any type of electrical connection or network structure within the truss system or interfacing to the truss system. In some preferred embodiments, two to five conductive truss elements 20 are used.

Figure 6:
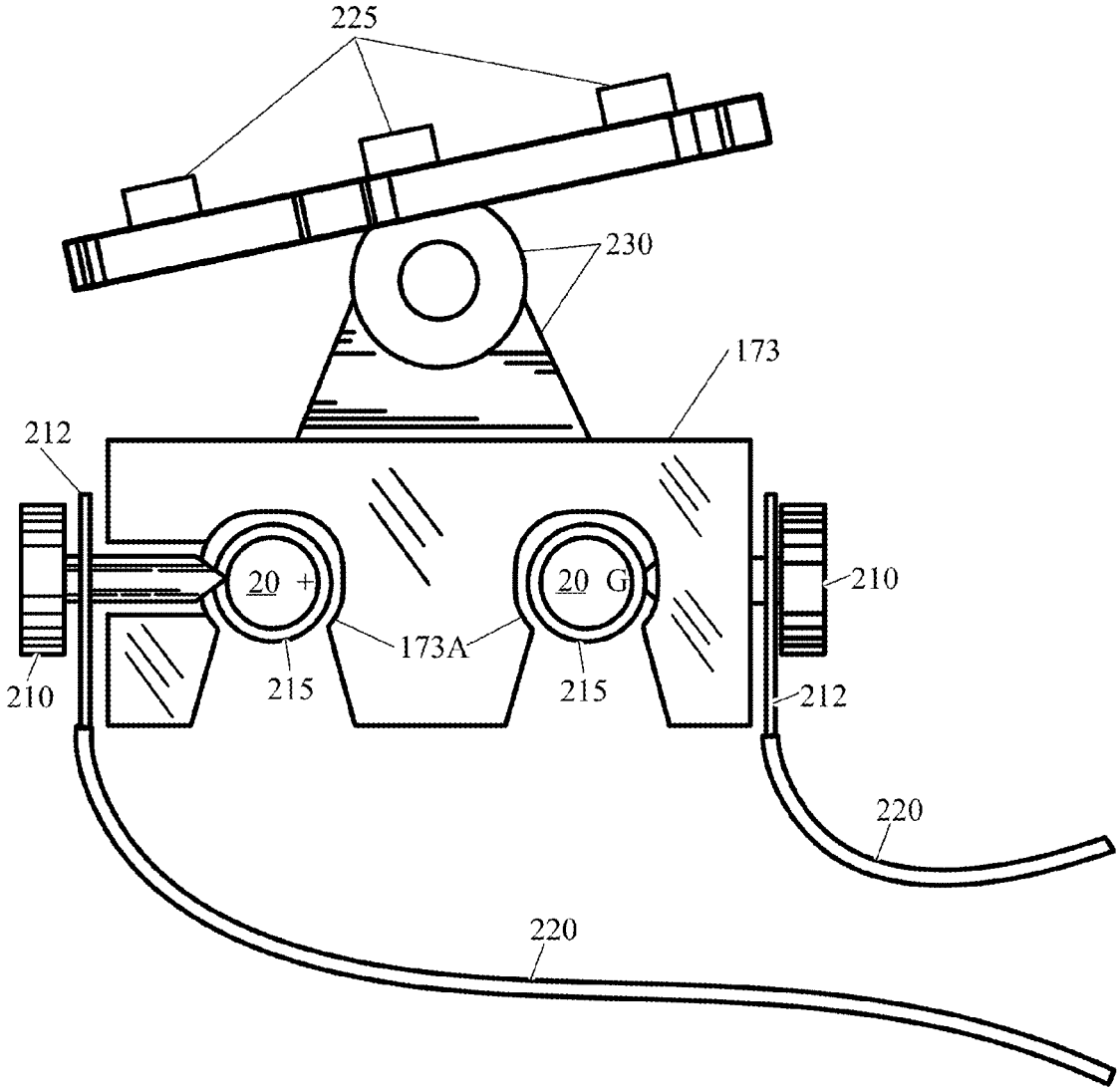
FIG. 6 shows a snap-on embodiment of an attachment module on an insulated conductive two rail structural element truss.

FIG. 6 shows another embodiment of an attachment module 173. In this embodiment, the attachment module 173 is of a press fit design with apertures 173A that partially surround the conducting truss structural elements 20, and may optionally be further secured by thumb screws 210 to each conducting truss structural element 20. In this embodiment, the conducting truss structural elements 20 are insulated 215, and the thumb screws 210 are appropriately shaped to pierce the insulation 215 when tightened. Thus, power and control signals are preferably communicated through conventional wiring 220 by connecting the conventional wiring 220 to the thumb screws 210 using a wire eyelet 212 or another appropriate connection. The pinball game feature shown in FIG. 6 is an LED array 225 mounted on a swiveled pylon 230 such that it may be oriented in user selectable directions.

Figure 7:
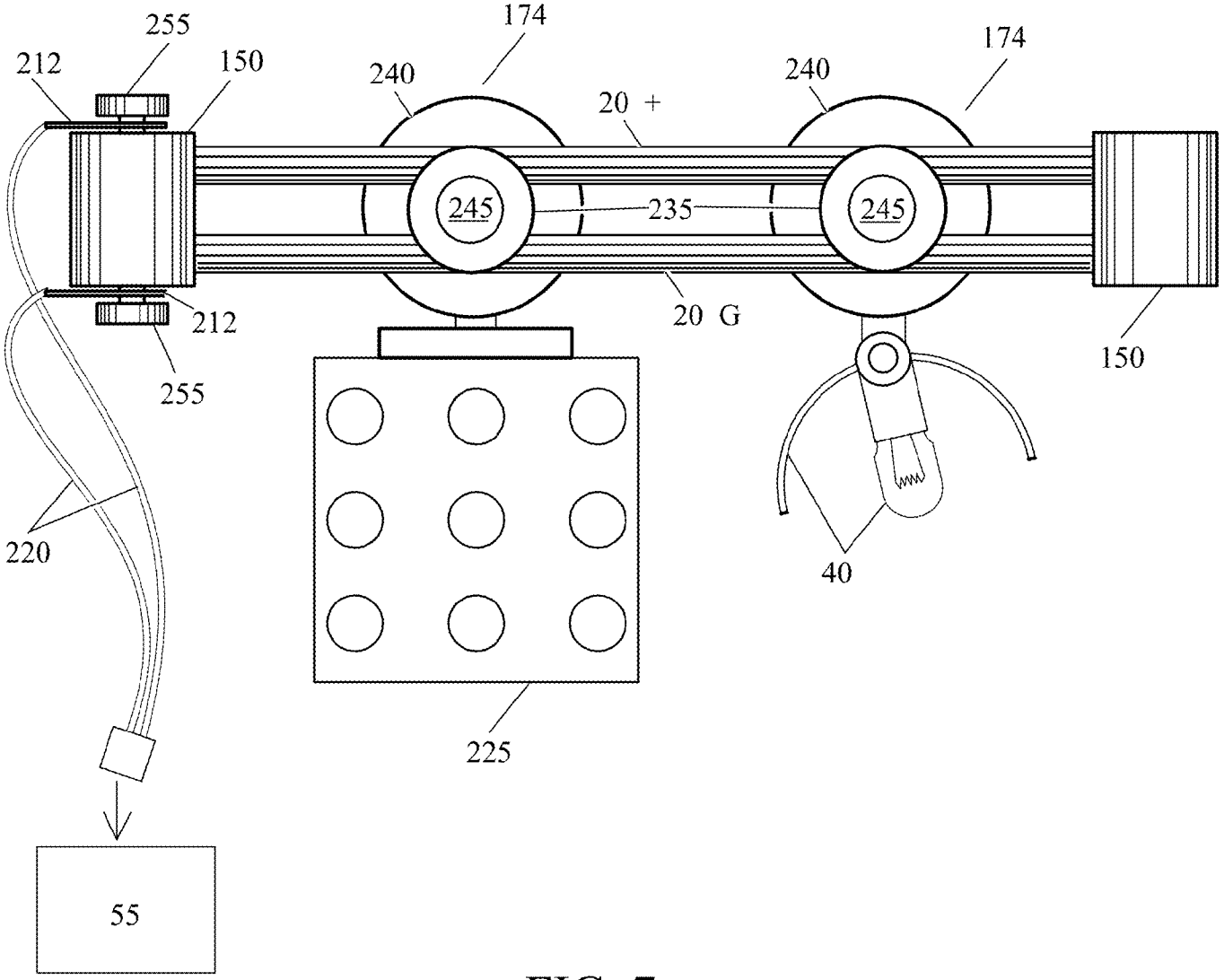
FIG. 7 shows a top view of an embodiment of a two piece attachment module in conjunction with a conductive two rail structural element truss, truss power/control connections, and pinball game features attached to each attachment module.
Figure 8:
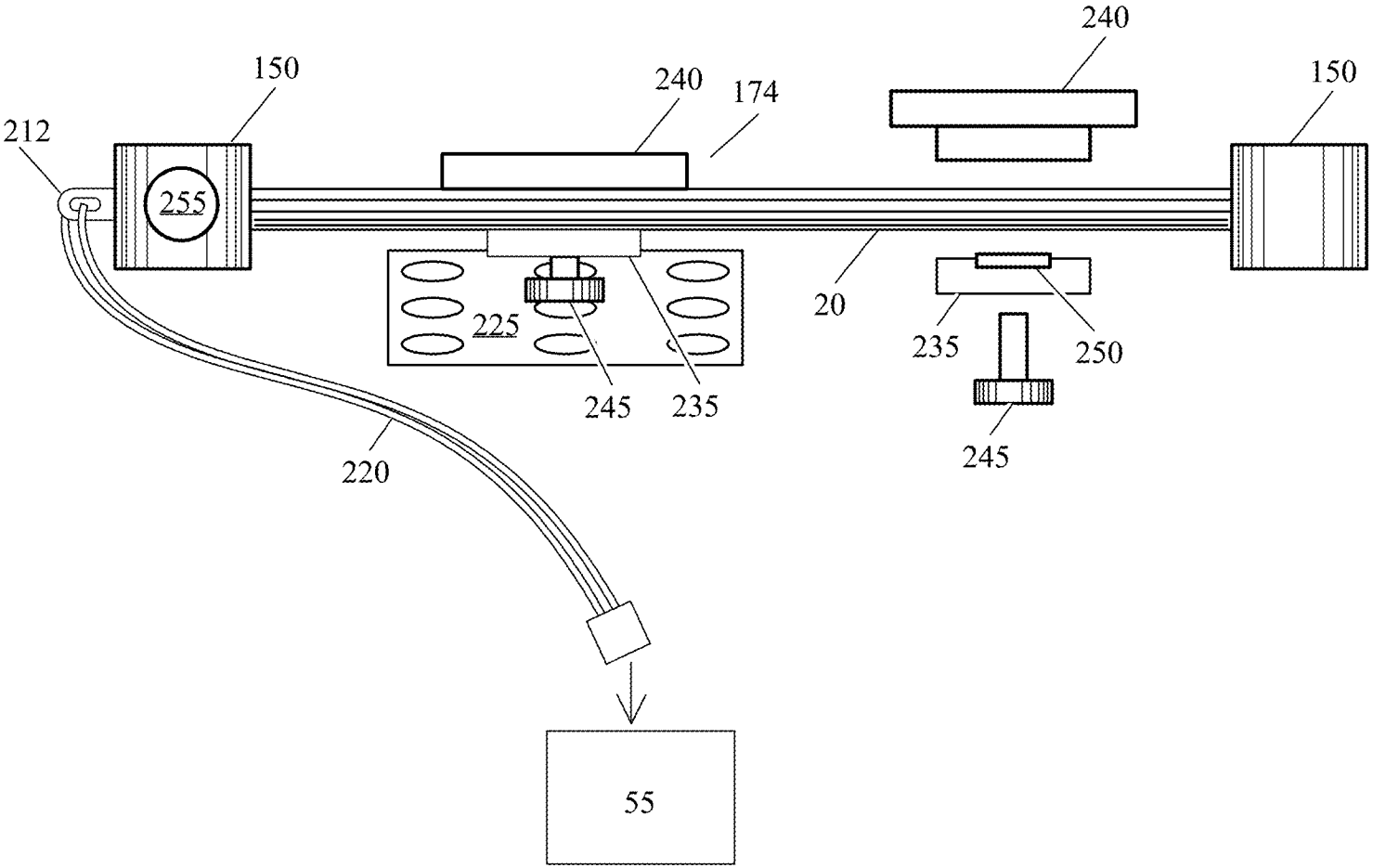
FIG. 8 shows a side view of an embodiment of a two piece attachment module in conjunction with a conductive two rail structural element truss, truss power/control connections, and pinball game features attached to each attachment module.

FIG. 7 and FIG. 8 show an embodiment of two plate attachment modules 174, each including a front plate 235 and a rear plate 240 clamping conducting truss structural elements 20 via a single thumb screw 245 connecting the front plate 235 and the rear plate 240. One of the front plate 235 and rear plate 240 attachment modules 174 in FIG. 7 supports an LED array 225 and the other front plate 235 and rear plate 240 attachment module 174 supports a spot light 40. FIG. 8 shows another view of the embodiments shown in FIG. 7, however the spotlight 40 is not shown in this figure. Contacts 250 on the front plate 235 draw power and/or control signals from the conducting truss structural elements 20.

Grooves may be formed in the location of the contacts 250 of the attachment module 174 to ensure maximum contact with the conducting truss structural elements 20, and to prevent the attachment module 174 from rotating when secured to the conducting truss structural elements 20. In this embodiment, the conducting truss structural elements 20 are provided with a post collar 150 on each end of the conducting truss structural elements 20, and conventional wiring 220 connected to a wire eyelet 212 or another appropriate connection connects the conducting truss structural elements 20 to the programmable truss controller 55 or an existing game power point and/or control line, for example, through thumb screws 255 in one of the post collars 150.

Figure 9:
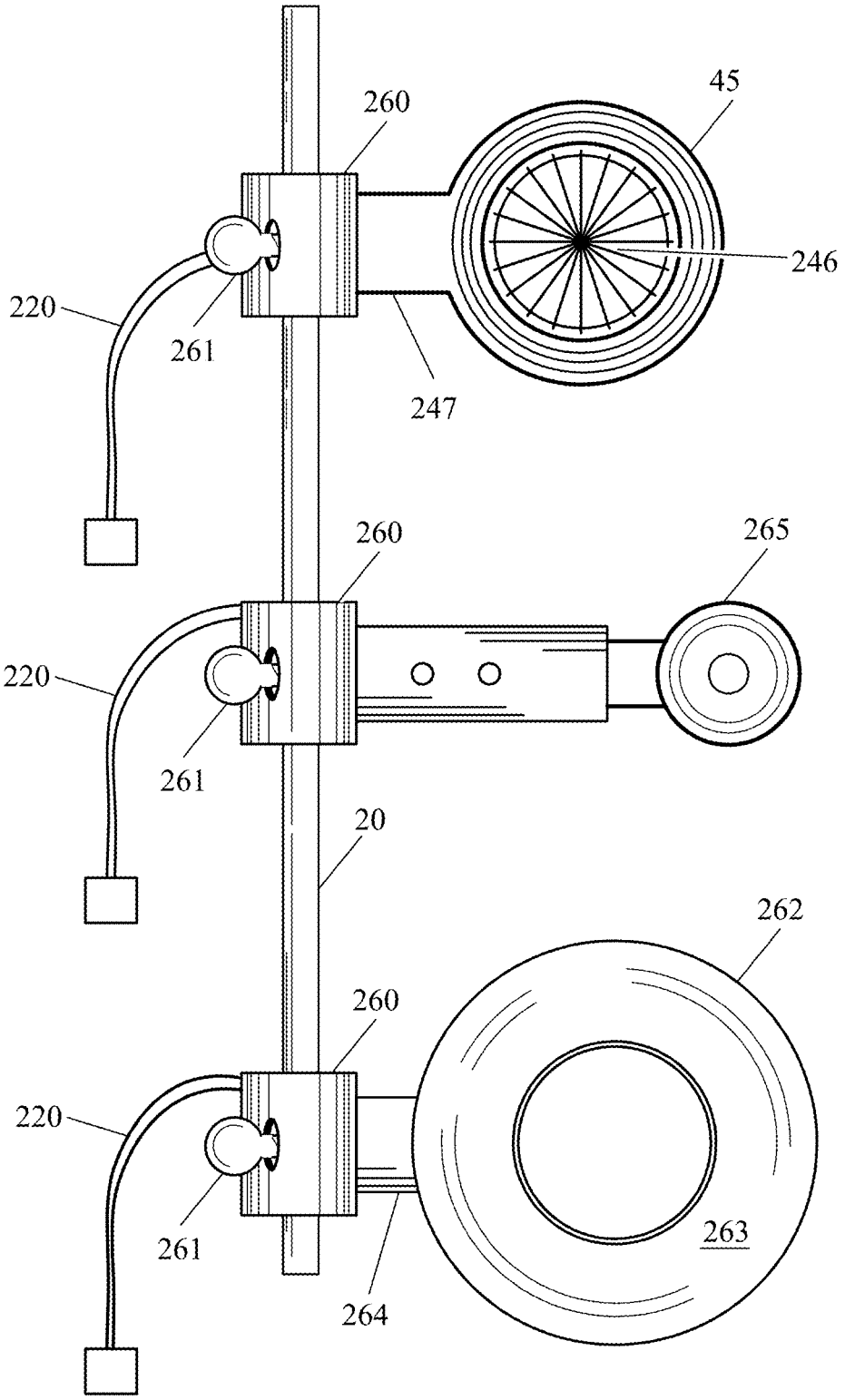
FIG. 9 shows a front view of a single rail structural element truss with three different pinball game features attached via a single rail attachment module in an embodiment of the present invention.

FIG. 9 shows an embodiment of a single truss structural element 20 connected to game features with single aperture attachment modules 260. Each of the attachment modules 260 in FIG. 9 include a thumb screw 261. A single truss structural element 20 is useful, for example, as a primary structure for making short extensions to other truss structural elements 20, cross connections to truss structural elements 20 near each other, or adding a T-section to a single truss structural element 20. In such configurations, it may not be necessary to provide power or control through the single truss structural element 20. Hence, single aperture attachment modules 260 that are structural in form may be used, and electrical connections to the attached pinball game features may be provided through conventional wiring 220 to conducting truss structural elements 20, or a remote power and control point.

Three types of pinball game features are shown in FIG. 9. A magnetic solenoid feature 262 includes a solenoid module 263 that is connected to the attachment module 260 by way of a solenoid holder 264, and may capture a pinball in a magnetic field, or deflect the path of a pinball, when the magnetic solenoid feature 262 is activated. A bull's eye target leaf switch 265 and a lamp with a diffuser lens 45, which includes a flash lamp 246 and a flasher holder 247, are also shown.

Figure 10A:
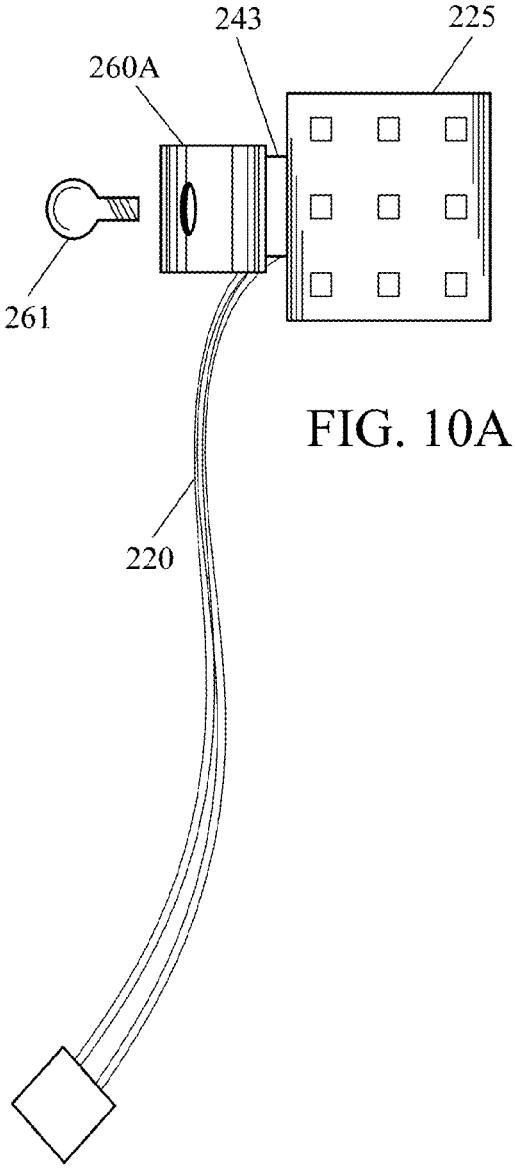
FIG. 10A shows a front view of an LED array pinball game feature in conjunction with a single rail attachment module.
Figure 10B:
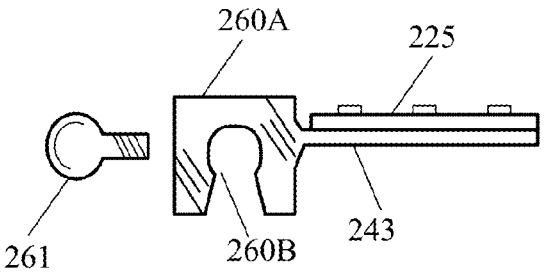
FIG. 10B shows a side view of an LED array pinball game feature in conjunction with a single rail attachment module.
Figure 11A:
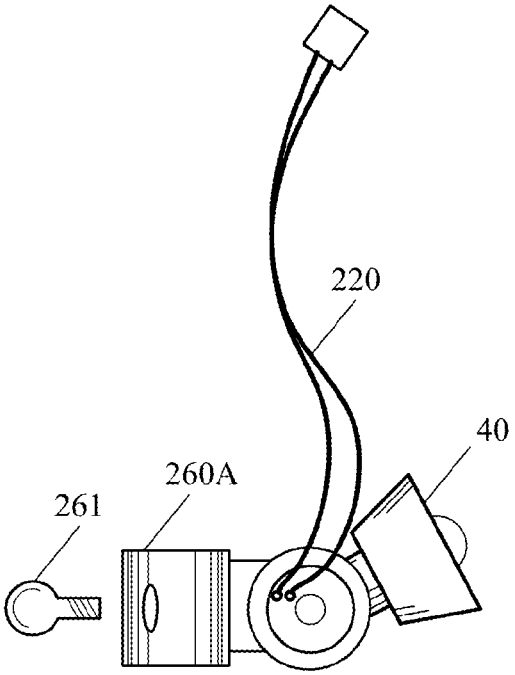
FIG. 11A shows a front view of a spotlight pinball game feature in conjunction with a single rail attachment module.
Figure 11B:
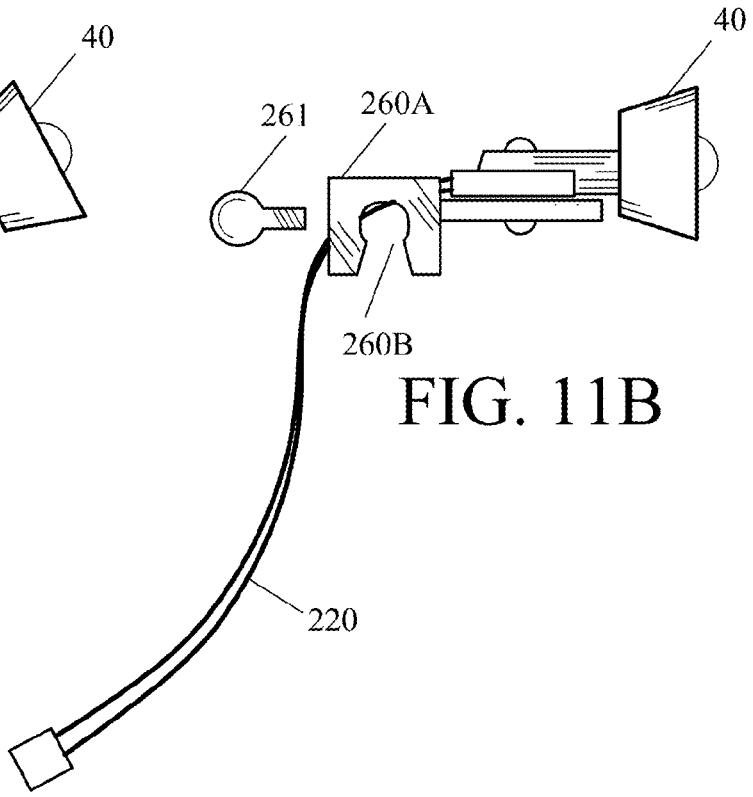
FIG. 11B shows a side view of a spotlight pinball game feature in conjunction with a single rail attachment module.
Figure 12A:
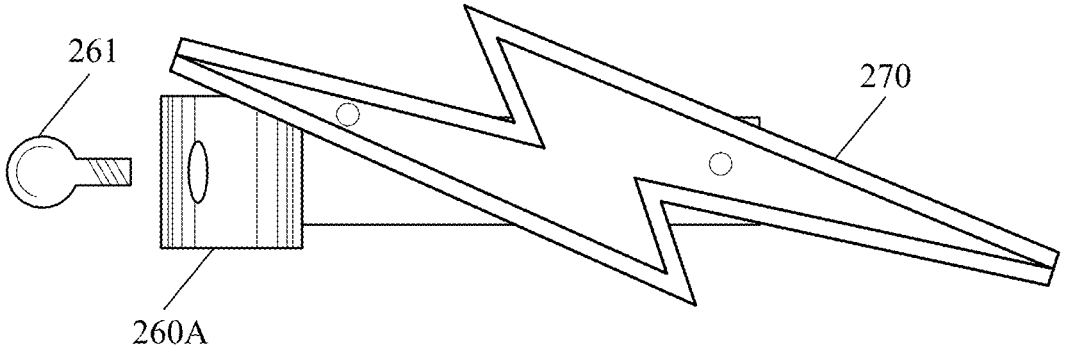
FIG. 12A shows a front view of a back-lit decorative transparent plastic pinball game feature in conjunction with a single rail attachment module.
Figure 12B:
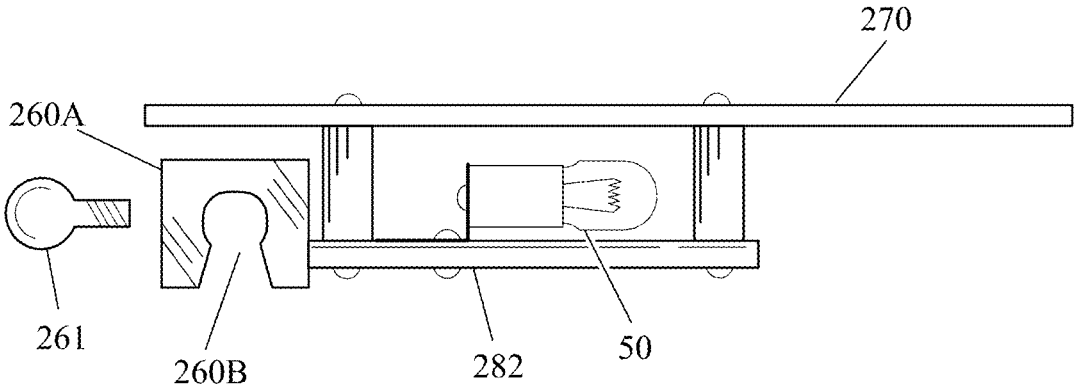
FIG. 12B shows a side view of a back-lit decorative transparent plastic pinball game feature in conjunction with a single rail attachment module.
Figure 13A:
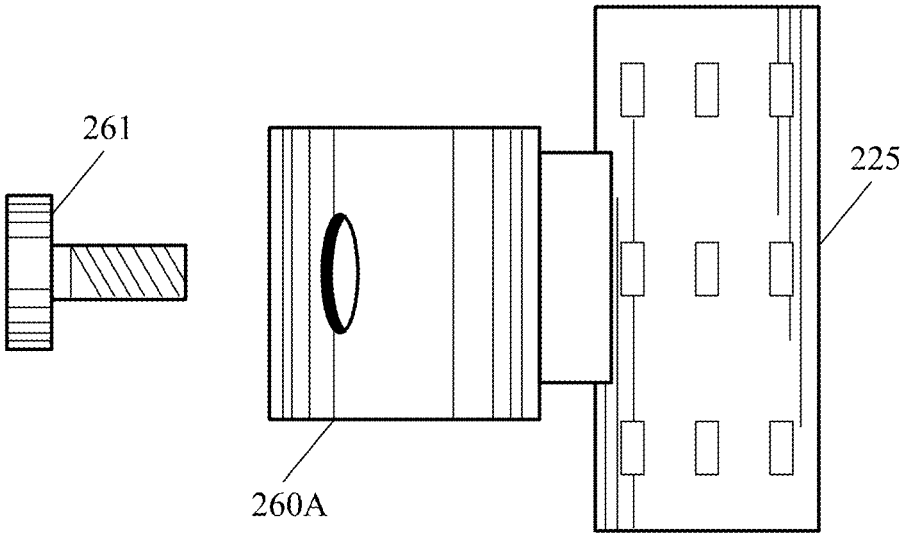
FIG. 13A shows a top view of an LED array pinball game feature in conjunction with a single rail attachment module.
Figure 13B:
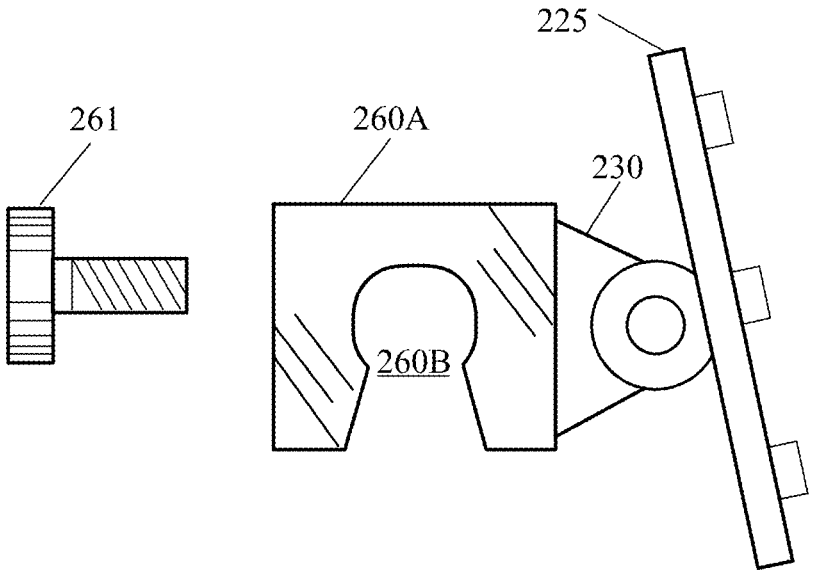
FIG. 13B shows a side view of an LED array pinball game feature in conjunction with a single rail attachment module.
Figure 14A:
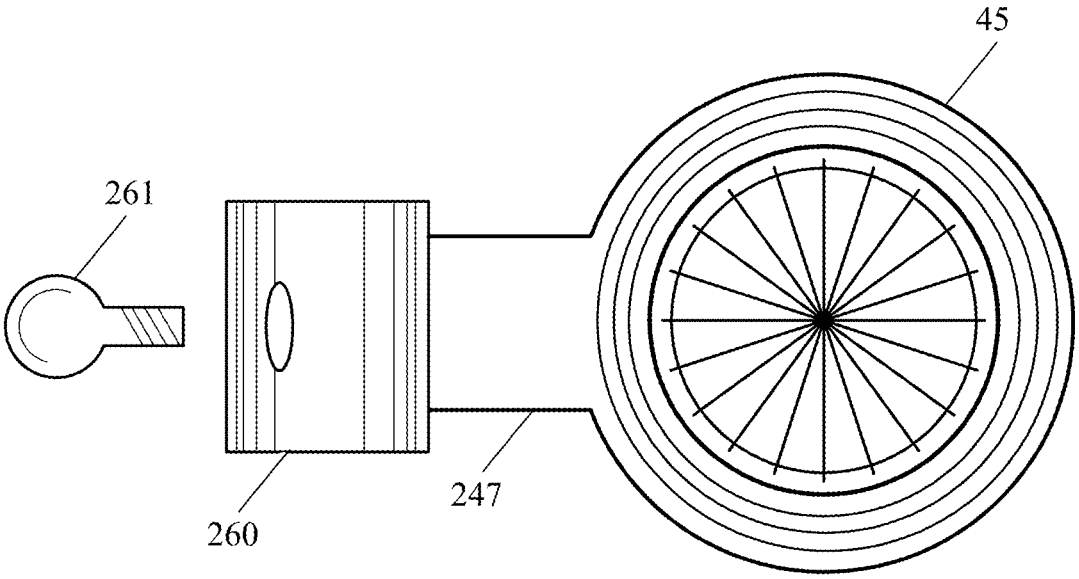
FIG. 14A shows a front view of a lamp with a diffuser pinball game feature in conjunction with a single rail attachment module.
Figure 14B:
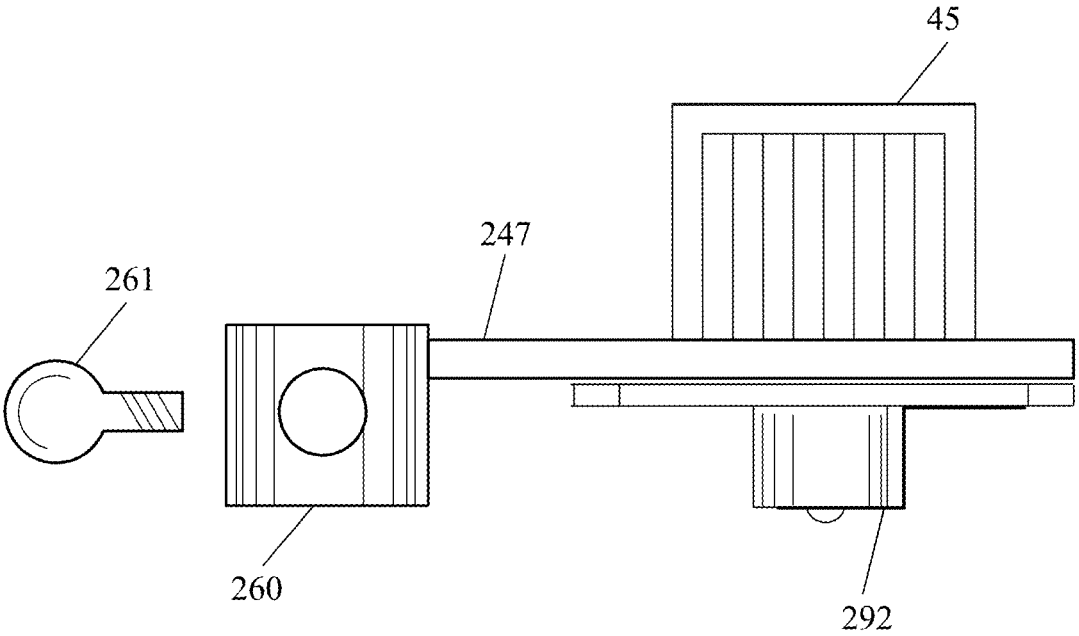
FIG. 14B shows a side view of a lamp with a diffuser pinball game feature in conjunction with a single rail attachment module.
Figure 15A:
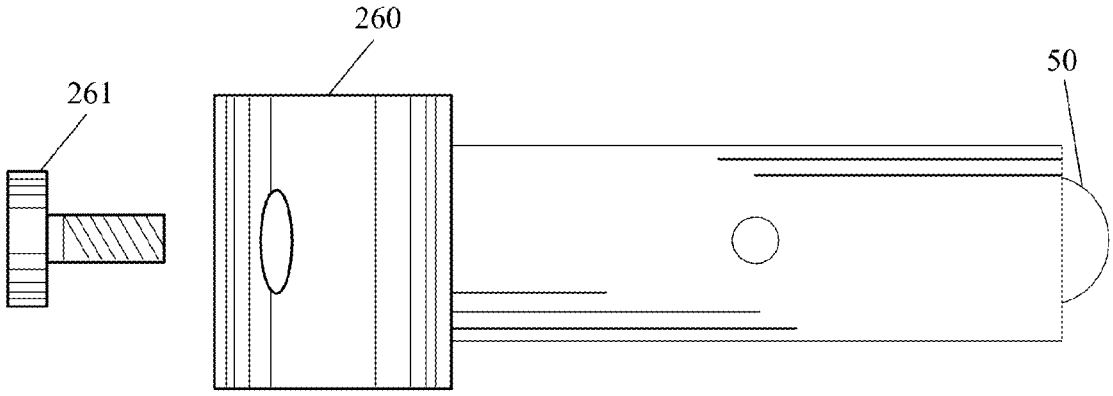
FIG. 15A shows a front view of an illumination lamp pinball game feature in conjunction with a single rail attachment module.
Figure 15B:
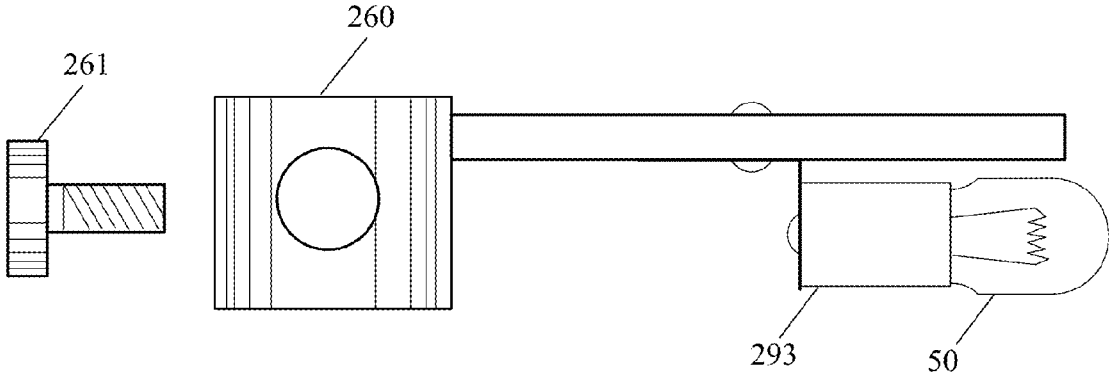
FIG. 15B shows a side view of an illumination lamp pinball game feature in conjunction with a single rail attachment module.

FIG. 10A and FIG. 10B also show a single aperture attachment module 260A for use with a single truss structural element 20, in conjunction with an LED array 225 pinball game feature. The single aperture attachment module 260 is a snap on type fitting with an aperture 260B that partially surrounds a truss structural element 20 and is optionally secured in place with a thumb screw 261. The attachment module 260A in FIGS. 10A and 10B also include a LED array holder or base 243 for holding the LED array 225.

FIGS. 11A through 16B demonstrate a partial variety of the types of pinball game features that are supported by the truss system described herein. Although each of these features is shown with a single aperture attachment module 260, 260A, any of the attachment module configurations 170, 172, 173, 174, 260, 260A described herein may be combined with virtually any type of pinball game feature that is capable of being suspended over the pinball game playfield 10 of a pinball game. Additionally, while conventional wiring 220 is shown with each pinball game feature, conductors may also be integrated into the attachment modules 170, 172, 173, 174, 260, 260A as previously described to derive power and control signals from truss structural elements 20 as necessary without exposed wiring.

Figure 16A:
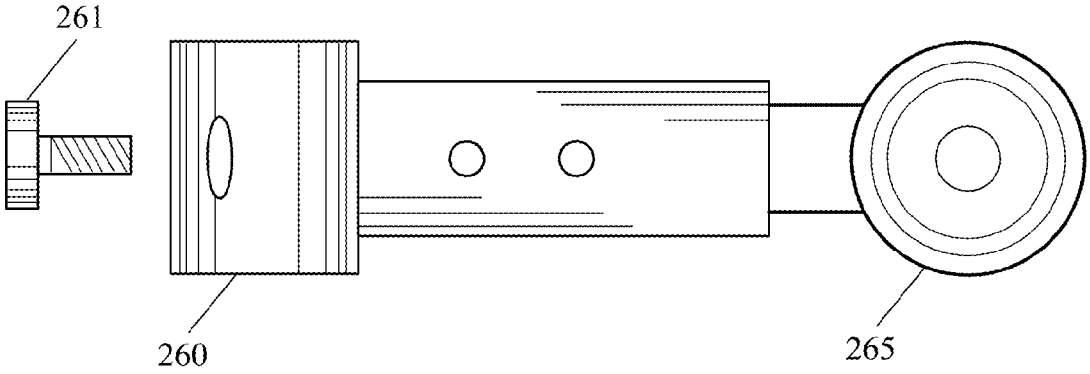
FIG. 16A shows a front view of a bull's eye target switch pinball game feature in conjunction with a single rail attachment module.
Figure 16B:
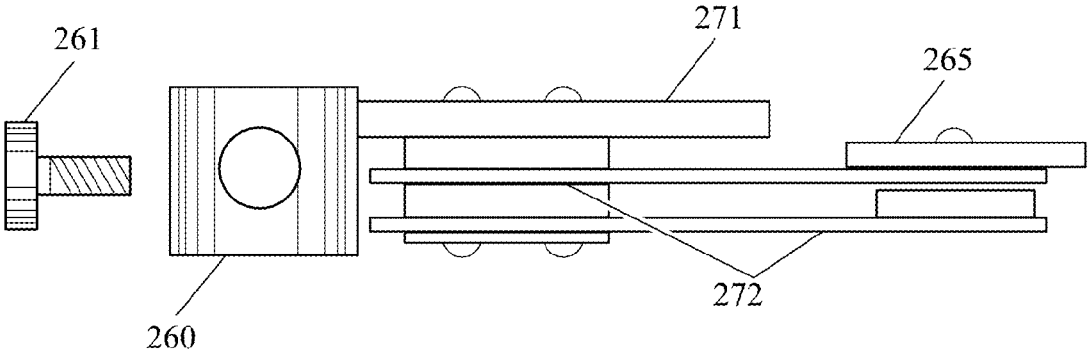
FIG. 16B shows a side view of a bull's eye target switch pinball game feature in conjunction with a single rail attachment module.

FIGS. 11A through 16B show a spotlight 40 (FIG. 11A, FIG. 11B), a transparent or translucent plastic 270 back lit with a conventional lamp 50 and a base 282 (FIG. 12A, FIG. 12B), an LED array 225 with swivel (FIG. 13A, FIG. 13B), a flasher lamp with diffuser cover 45, a base 292, and a mount arm 247 (FIG. 14A, FIG. 14B), a simple illumination lamp 50 with a base 293 (FIG. 15A, FIG. 15B), and a bulls eye target 265 with a leaf switch 272 and a support arm 271 (FIG. 16A, FIG. 16B). As previously noted, this list of pinball game features is not a comprehensive representation of all the pinball game features that may be used with the truss system described herein, and should not be considered limiting of the invention. Spinner targets, pop targets, electro-mechanical robotics, and virtually all manner of scoring pinball game features, target pinball game features, and lighting in use on pinball game pinball game playfields 10 may similarly be adapted to be operationally mounted on the truss system described herein.

The modular truss system provides new opportunities for game development that have heretofore not been possible with prior art pinball game design concepts and technologies. In the prior art, lamps and other pinball game features have been game specific and generally relegated to specific, manufacturer prescribed, locations in the pinball game. In contrast, the standard sockets 176 within attachment modules 170, 172, 173, 174, 260, 260A allows pinball game owners to create their own diffusers and back lit features, for example by using 3D printing technologies, by repurposing translucent figures to be part of a game, by making covers from blown glass or cast plastics, or creating a wide variety of other materials and forms. Further, particularly in combination with the PNN control 65 capabilities the truss system may provide, game owners and game operators may, for example, develop their own electro-mechanical robotic devices and integrate them into the pinball game through the standard interface the attachment modules 170, 172, 173, 174, 260, 260A and truss system provides.

Figure 17:
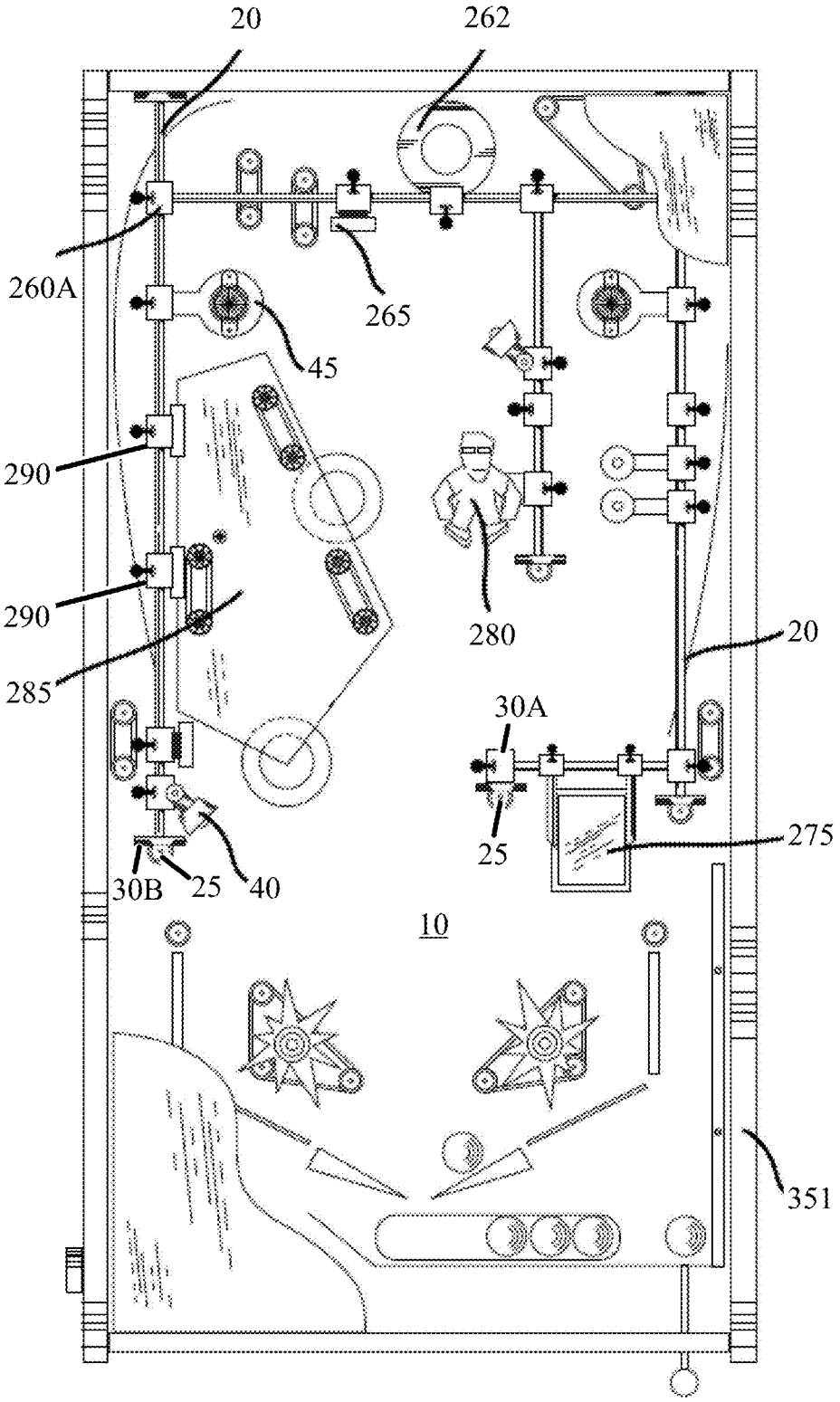
FIG. 17 shows a top view of a game cabinet and pinball game playfield with an exemplary arrangement of a truss system installed and enabling above pinball game playfield mounting of pinball game features, and secondary playfields.

FIG. 17 shows an example of an arrangement of a truss system described herein, in a top view of a pinball game playfield 10 in a pinball game cabinet 351. As shown, the truss system is arranged to span a variety of points on a pinball game playfield 10, and supports a wide range of pinball game features thereon, each of which may be customized or relocated at will. This figure shows lamps with diffusers 45, spotlights 40, bull's eye targets 265, LCD displays 275, electro-mechanical robotics 280, truss structural elements 20, attachment modules 260A, a solenoid magnet feature 262, truss posts 25, connector blocks 30A, 30B, and other pinball game features, as well as mount supports 290 holding a second level playfield 285.

Figure 18:
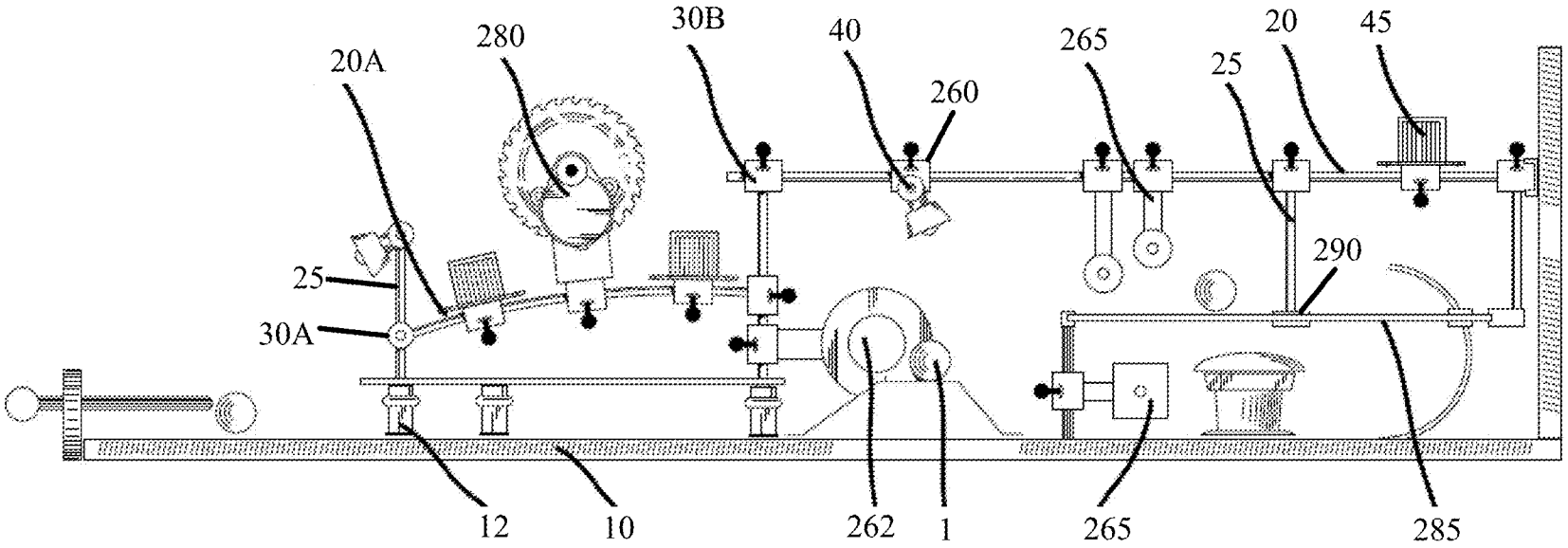
FIG. 18 shows a side view of a pinball game playfield with an exemplary arrangement of a truss system installed and enabling above pinball game playfield mounting of pinball game features, and secondary playfields.

FIG. 18 shows a side view of another arrangement of the truss system supporting pinball game features over a pinball game playfield 10. As shown, the truss system is used with mounting supports 290 as a support for additional playfield 285 levels accessible by ramps or other means. Further shown supported by truss structural elements 20, 20A are spot lights 40, bull's eye targets 265, lamps with diffusers 45, electro-mechanical robotics 280, a solenoid magnet feature 262 attracting a pinball 1, attachment modules 260, truss posts 25 connected to existing game posts 12 as well as mounting supports 290, and truss connector blocks 30A, 30B all used in combination. In addition, in some embodiments, truss structural elements 20A are flexible and be bent into arcuate forms to take full advantage of the three-dimensionality of the pinball game playfield 10 and cabinet space it is contained in. In this manner, the truss structural elements 20 may also be formed into rail ramps that lead from the existing pinball game playfield 10 up to additional playfield 285 levels that are supported by one or more truss structural elements 20 and held by mount supports 290 connected to the truss structural elements 20 and additional playfield 285.

Figure 19:
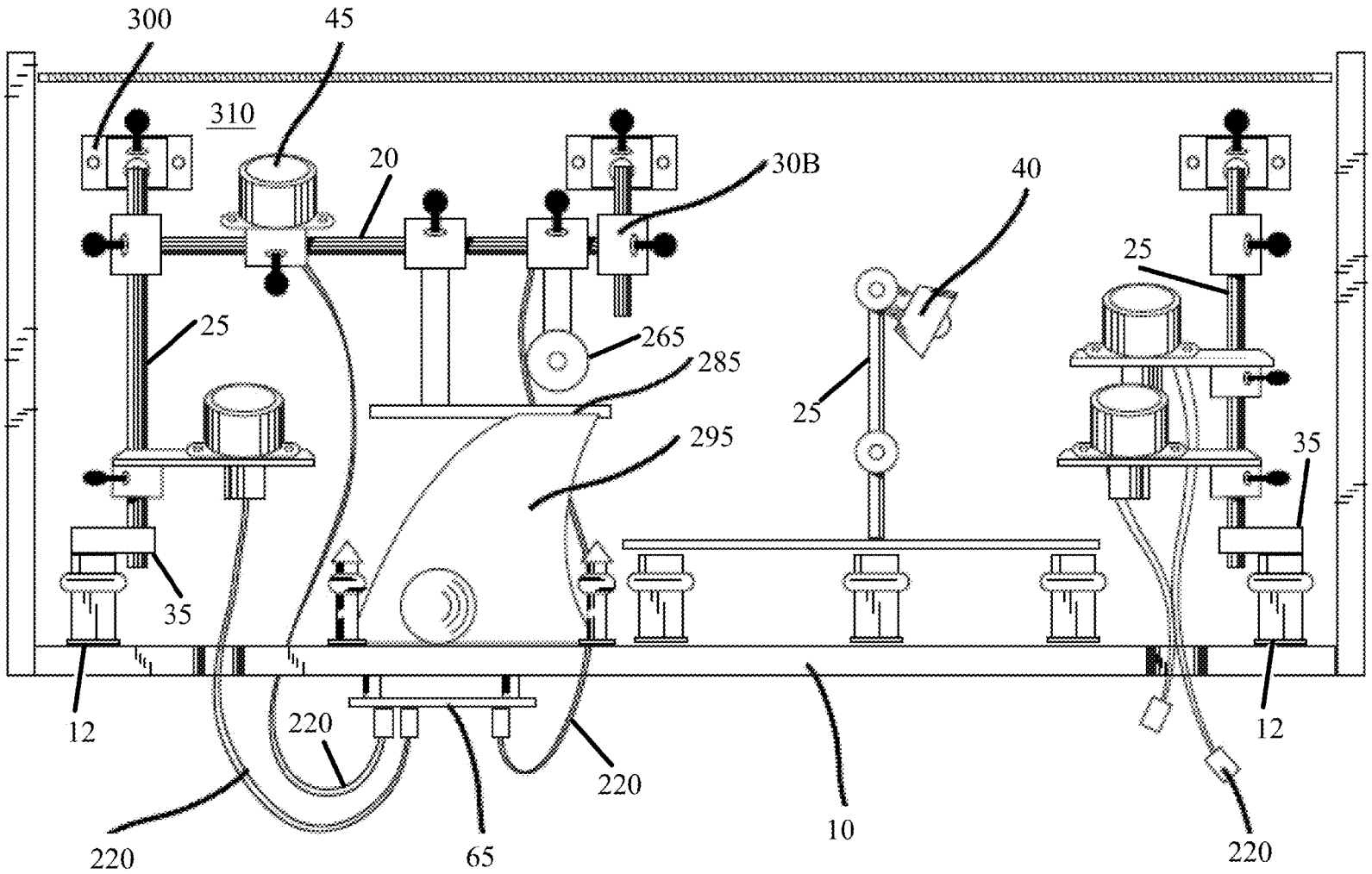
FIG. 19 shows a front view of a game cabinet and pinball game playfield with an exemplary arrangement of an embodiment of a truss system including cabinet mounts installed and enabling above pinball game playfield mounting of pinball game features, and secondary playfields.
Figure 20:
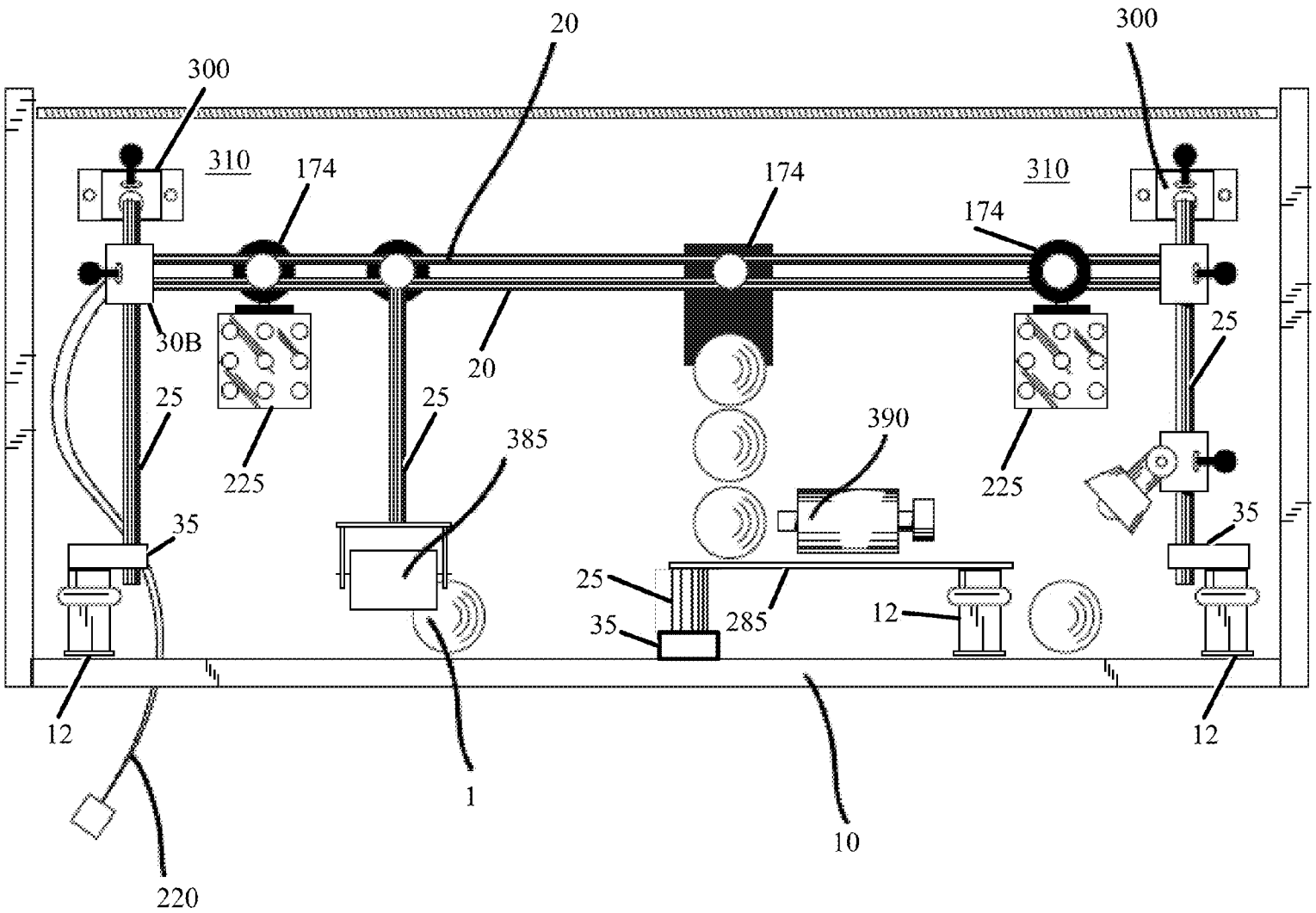
FIG. 20 shows a front view of a game cabinet and pinball game playfield with an exemplary arrangement of an embodiment of a truss system including cabinet mounts installed and enabling above pinball game playfield mounting of pinball game features.

FIG. 19 and FIG. 20 show the three-dimensionality that the truss system brings to the pinball game. In FIG. 19, ramp 295 leads to a second level playfield 285 with a bull's eye target 265, and a spot light 40 uses only a support post 25 to bring illumination to the pinball game playfield 10 without unduly obstructing the player's view of the pinball game playfield 10. A PNN 65 is located on an underside of the pinball game playfield 10 and is connected to pinball game elements 45, 265 by way of conventional wiring 220. Post sockets 35 are also used to connect truss posts 25 to the pinball game playfield 10 through existing game posts 12.

FIG. 20 shows two conducting truss structural elements 20. Power and control are provided by conventional wiring 20 by a connector block 30B connected to the truss structural elements 20. Cabinet mounts 300 support the truss system at the back wall 310 of the pinball game playfield 10. Post sockets 35 connect truss posts 25 to existing game posts 12, and also connect a truss post 25 supporting a second playfield 285 to the pinball game playfield 10. A kicker 390 pinball game feature is also supported by the second playfield 285. Attachment modules 174 are used to attach LED arrays 225, and a spinner 385 pinball game feature is also shown interacting with a pinball 1.

FIGS. 19 and 20 show cabinet mounts 300 supporting truss posts 25 and truss structural elements 20 at the back wall 310 of the pinball game playfield 10. The cabinet mount 300 may be screwed or adhered to the back wall 310 of the pinball game playfield 10 and may include appropriate recesses, posts, or hangers formed to accept and secure, for example, by set screws 320, truss structural elements 20. For example, an end of truss structural elements 20 or a truss collar 155 may be secured to the cabinet mount 300.

Figure 21A:
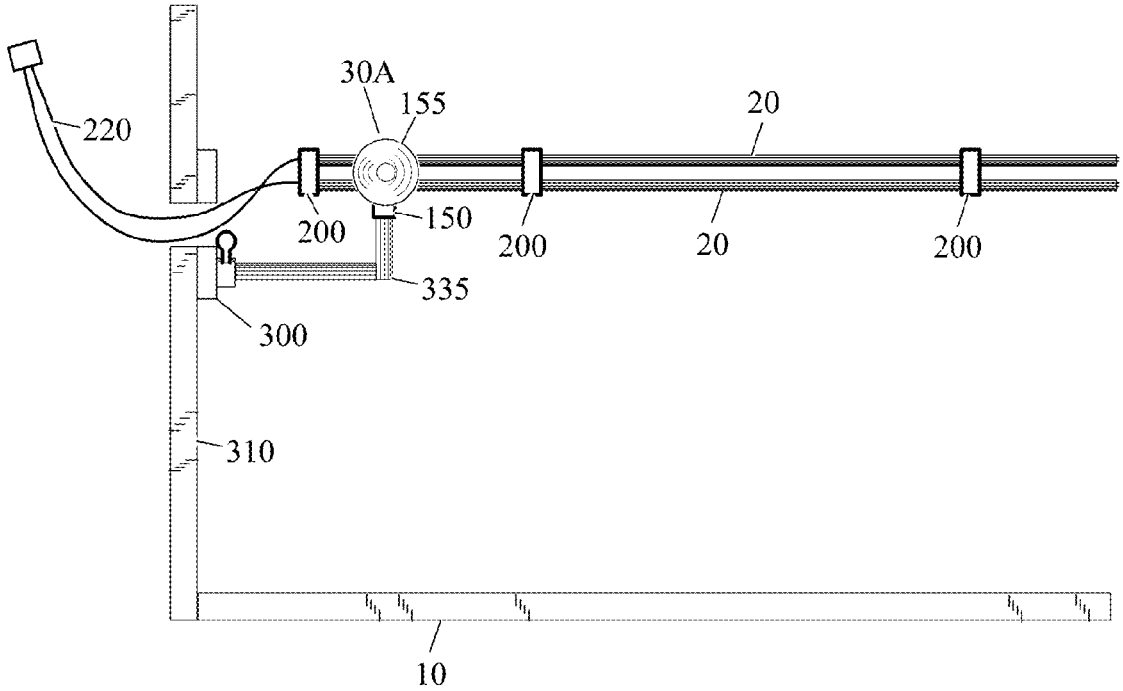
FIG. 21A shows a side view of a pinball game playfield back wall and playfield with an exemplary arrangement of an embodiment of a truss system including one embodiment of a cabinet mount.
Figure 21B:
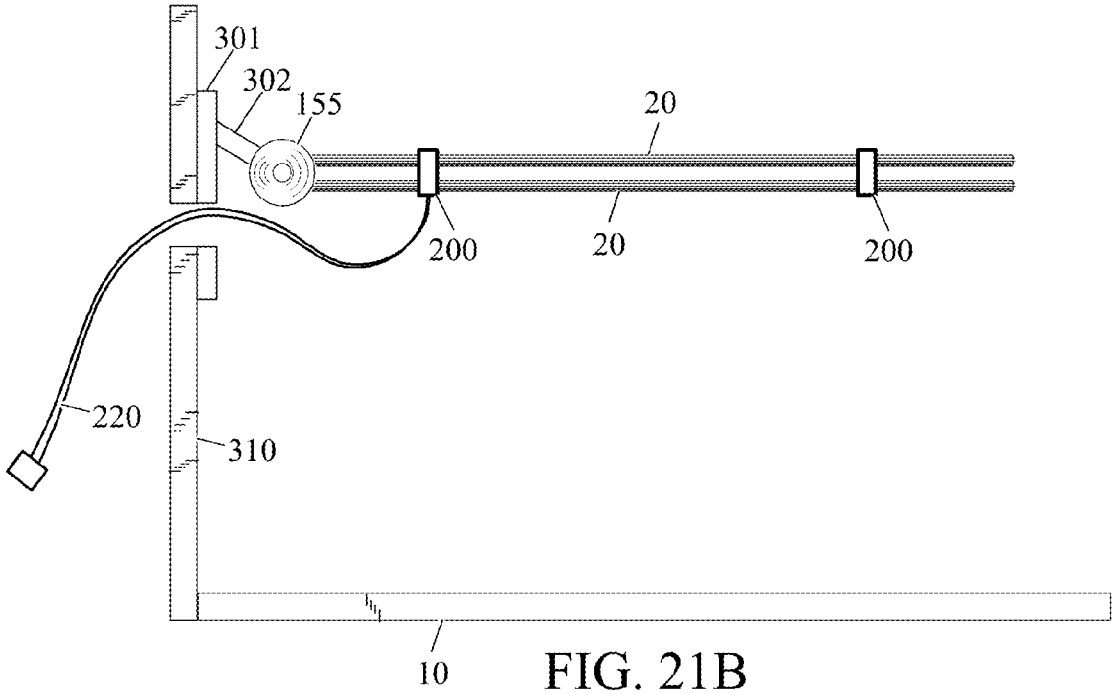
FIG. 21B shows a side view of a pinball game playfield back wall and pinball game playfield with an exemplary arrangement of an embodiment of a truss system including an alternate embodiment of a cabinet mount.

The cabinet mounts 300, 301 shown in FIGS. 21A and 21B may also be used as a source of power and control signals to the truss structural elements 20 by integrating contacts into truss spacers 200. Such an installation is advantageous as it allows conventional wiring 220 to be passed through the back wall 310 of the pinball game playfield 10 where it will not detract from the aesthetics of the game. In one embodiment, shown in FIG. 21A, the cabinet mount 300 has an L-post 335 that may be used in conjunction with a truss connector block 30A, having a truss collar 155 and a post collar 150. In FIG. 21B, a truss collar 155 has been modified to accept pins or other attachment points 302 of an outrigger or bracket which forms part of the cabinet mount 301.

Figure 22:
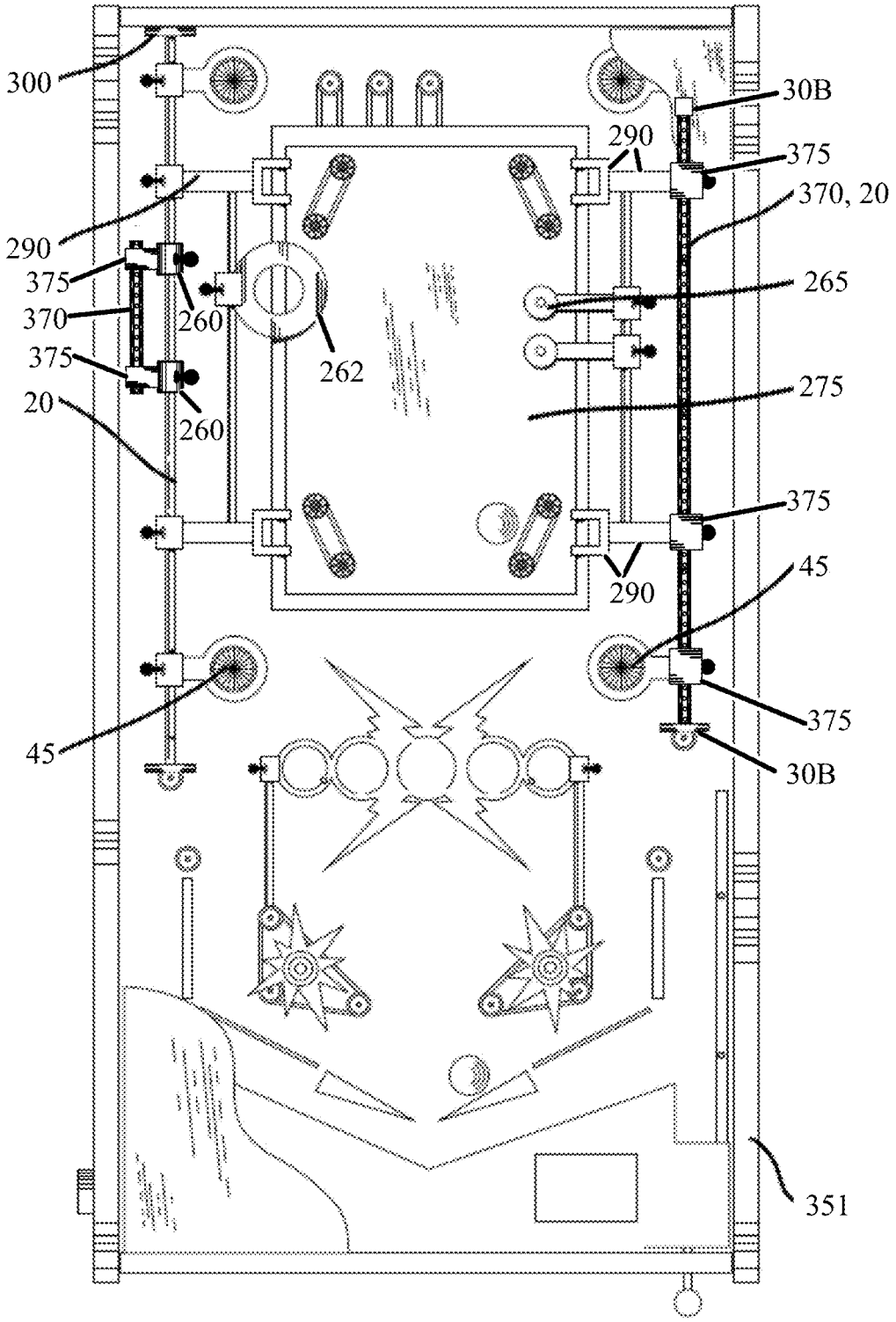
FIG. 22 shows a top view of a game cabinet and pinball game playfield with an exemplary arrangement of an embodiment of a truss system installed and enabling above pinball game playfield mounting of pinball game features, and a secondary playfield including an LCD display and pinball game features associated with that secondary LCD display playfield.

FIG. 22 further shows the expansion capabilities the truss system provides by mounting an LCD display 275 above an existing pinball game playfield 10, creating a second level playfield 285. In prior art pinball games, scoring opportunities have not generally been available above an LCD display 275 because the presence of the LCD display 275 precluded the use of standard pinball game features that rely on mechanisms and connections under the pinball game playfield 10 to operate.

However, the truss system described herein provides for not only supporting the LCD display 275, for example by mount supports 290, but also allows targets and other pinball game features to be mounted above the LCD display 275 with the truss system for more dynamic pinball game play and more scoring opportunities. In this figure, for example, a truss structural element 20 is shown being held between a cabinet mount 300 and a truss connector block 30B attached to a truss post 25. The truss system shown not only provides for suspension of the LCD display 275 by mount supports 290, but also shows a bull's eye target 265 and a solenoid magnet 262 pinball game feature as two examples of pinball game features that may be mounted on the truss system above an LCD display 275.

Figure 26:
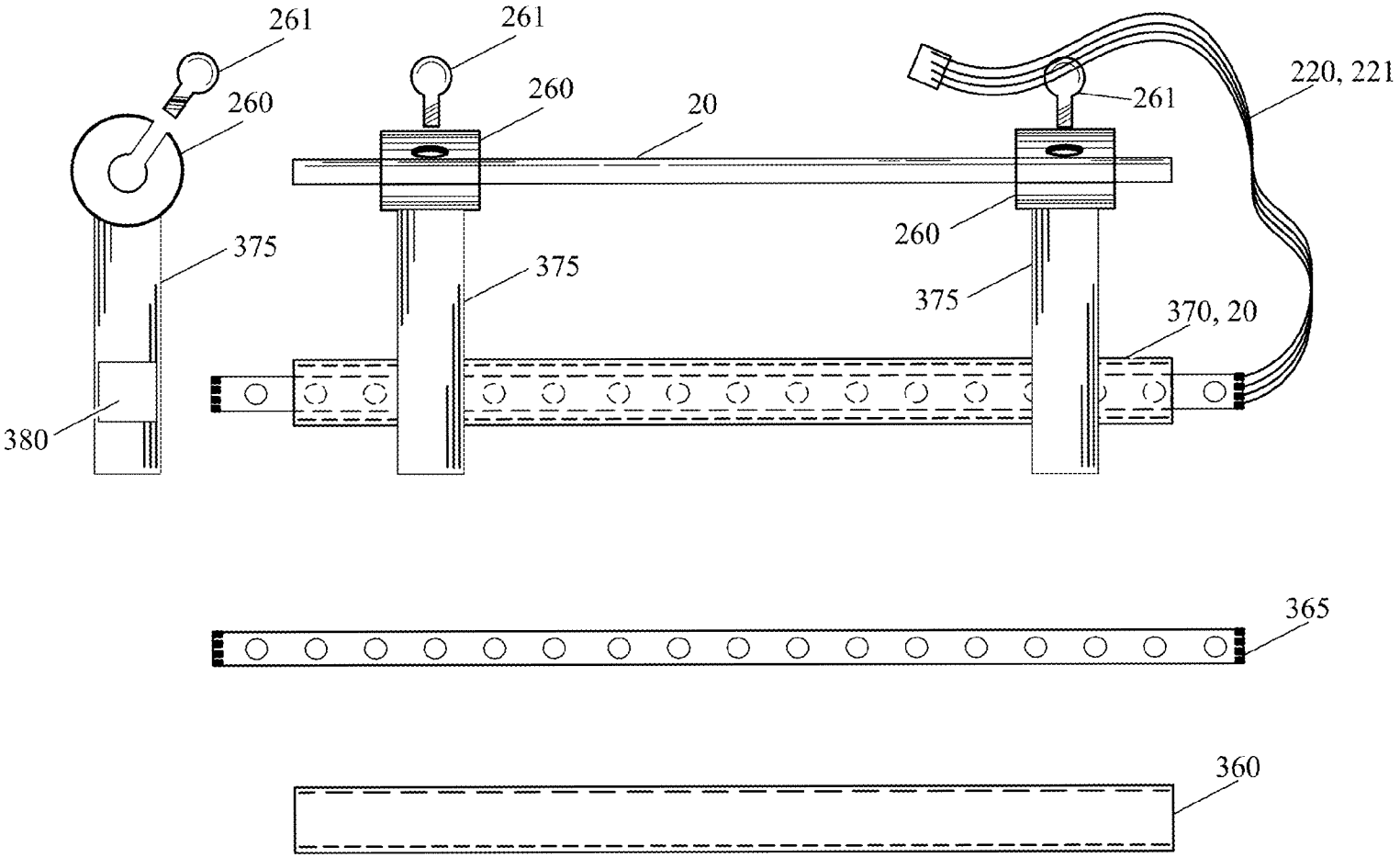
FIG. 26 shows a pinball game LED lighting feature attached to a structural truss element and an alternate embodiment of an attachment module.

FIG. 22 also shows two embodiments of a linear LED array lighting feature 370, which is also described in further detail with regard to FIG. 26. In one embodiment, the linear LED array lighting feature 370 is attached to a truss structural element 20 by way of two attachment modules 260, and two supports 375 with an aperture 380 through which the linear LED array lighting feature 370 passes. In a second embodiment, a linear LED array lighting feature 370 is also used as a truss structural element 20. In this embodiment, the support 375 is mated to, for example, mount supports 290, and connects a side of the LCD display 270 to the truss system. The linear LED array lighting feature 370 used as a truss structural element 20 is supported by two connector blocks 30B at each end of the linear LED array lighting feature 370.

The truss structural elements 20 have been described thus far herein primarily in terms of their structural function and conductivity. However, truss structural elements 20 having a variety of structural forms that also enable the support and conductor structures described herein are also within the scope of this truss system.

Figure 23:
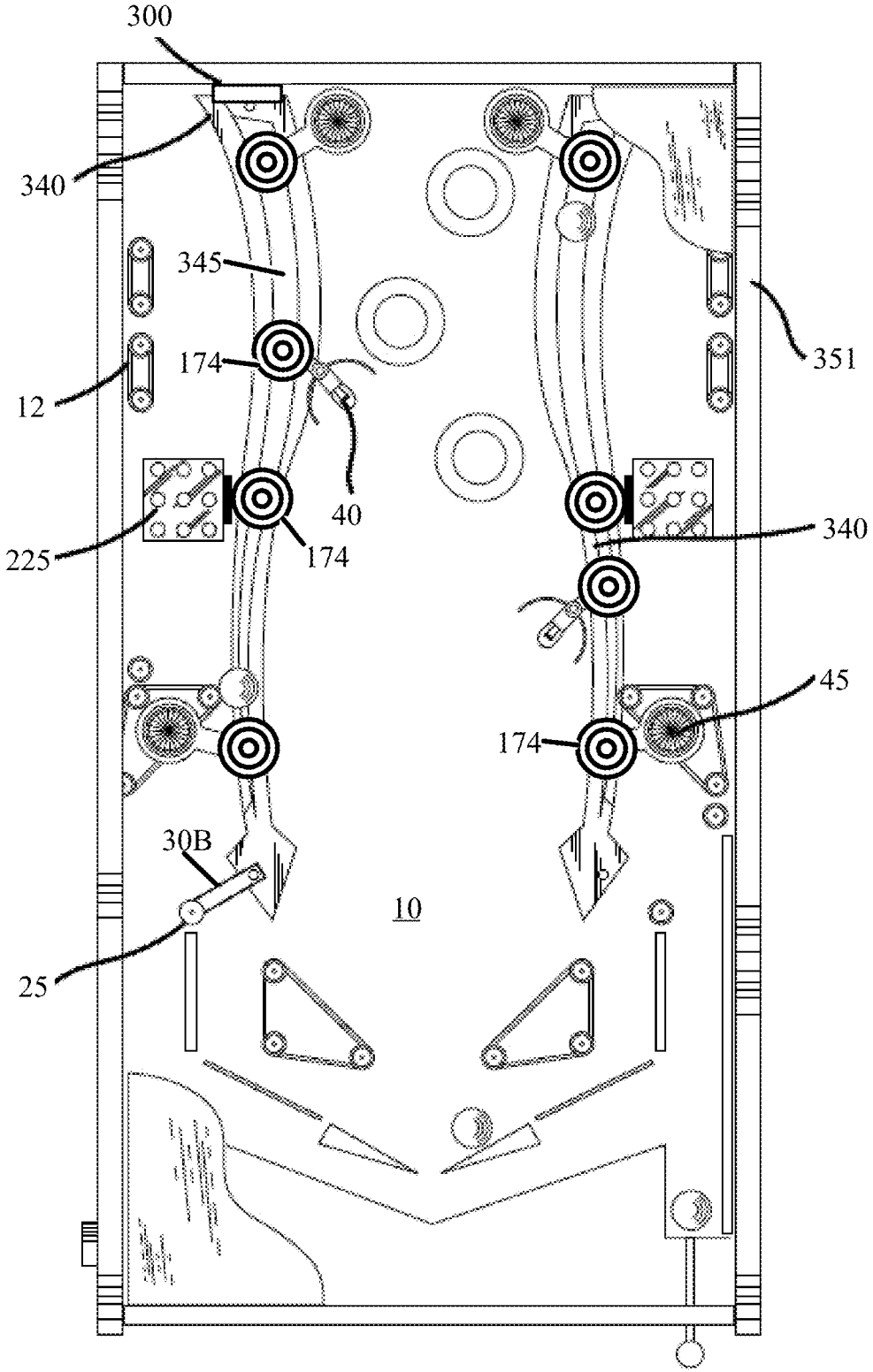
FIG. 23 shows a top view of a game cabinet and pinball game playfield with an exemplary arrangement of an embodiment of a decorative and conductive structural element truss system installed and enabling above pinball game playfield mounting of pinball game features.

As one illustrative example, FIG. 23 shows two truss structural elements 340 shaped in the form of curves having spiked ends suspended above a pinball game playfield 10 inside a pinball game cabinet 351. Such truss structural elements 340 may be formed out of sheet plastic, molded plastic, 3D printing technologies, or other suitable materials and methods, and may take any three dimensional shape. A channel 345 may, for example, be formed along the central axis of these truss structural elements 340 to accommodate any of the attachment modules 170, 172, 173, 174, 260, 260A described herein.

Conductors may be provided on an under-side of these truss structural elements 340, through etching, adhesion, or other methods, to mate with an attachment module 170, 172, 173, 174, 260, 260A, or cabinet mount 300, 301, for example. In this figure, attachment modules 174 are shown supporting spot lights 40, an LCD array 225, and a diffuser 45 with a lamp on the truss structural elements 340. The truss structural elements 340 may be supported above the playing field 10, for example, by a cabinet mount 300 at one end, and a truss mounting block 30B attached to a truss post 25 at another end. This illustration should not be considered limiting on the truss structural elements 340, as any combination of the mounting block 30A, 30B or other truss system elements described herein may be readily adapted to supporting the truss structural elements 340.

Figure 24:
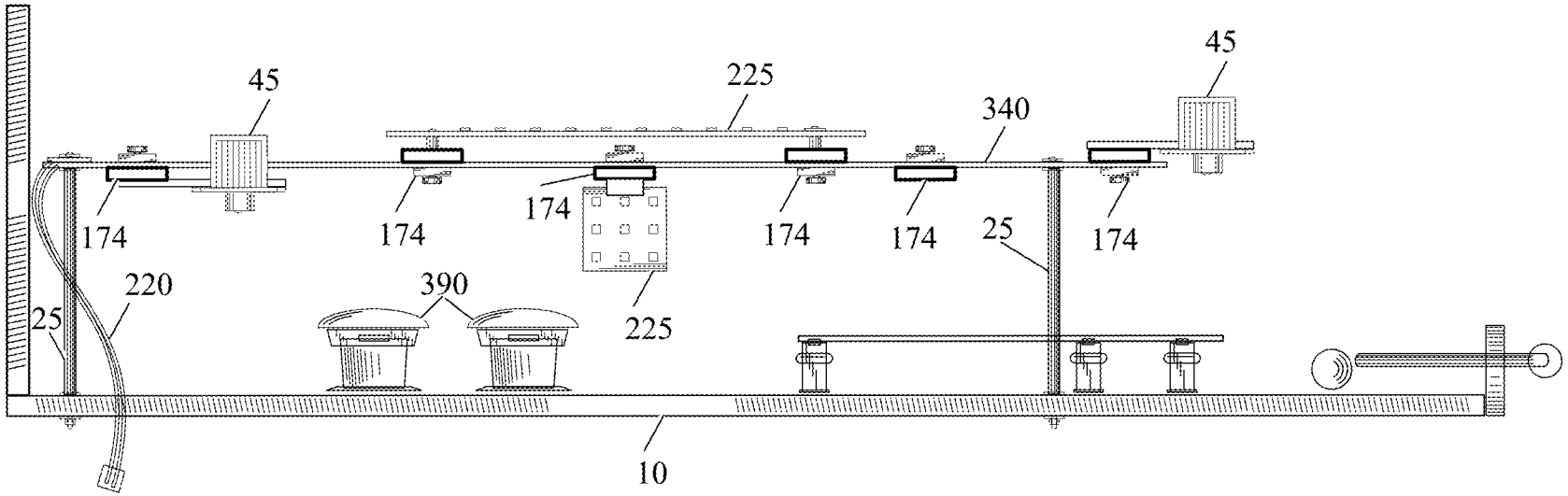
FIG. 24 shows a side view of a pinball game playfield back wall and pinball game playfield with an exemplary arrangement of an embodiment of a decorative and conductive structural element truss system installed and enabling above pinball game playfield mounting of pinball game features.

FIG. 24 shows a side view of a pinball game playfield 10 with truss structural elements 340, as shown in FIG. 23, incorporated onto the pinball game playfield 10 using truss posts 25. As can be seen from this figure, truss structural elements 340 may also optionally incorporate power and control conductors through conventional wiring 220 connected directly to the truss structural elements 340, or connected to an attachment module 170, 172, 173, 174, 260, 260A. In this illustration conventional pop bumper 390 pinball game features are shown attached to the pinball game playfield 10. LED arrays 225 and diffusers 45 with lamps are shown attached to the truss structural elements 340 by attachment modules 174, and derive power and/or control signals therefrom.

Figure 25:
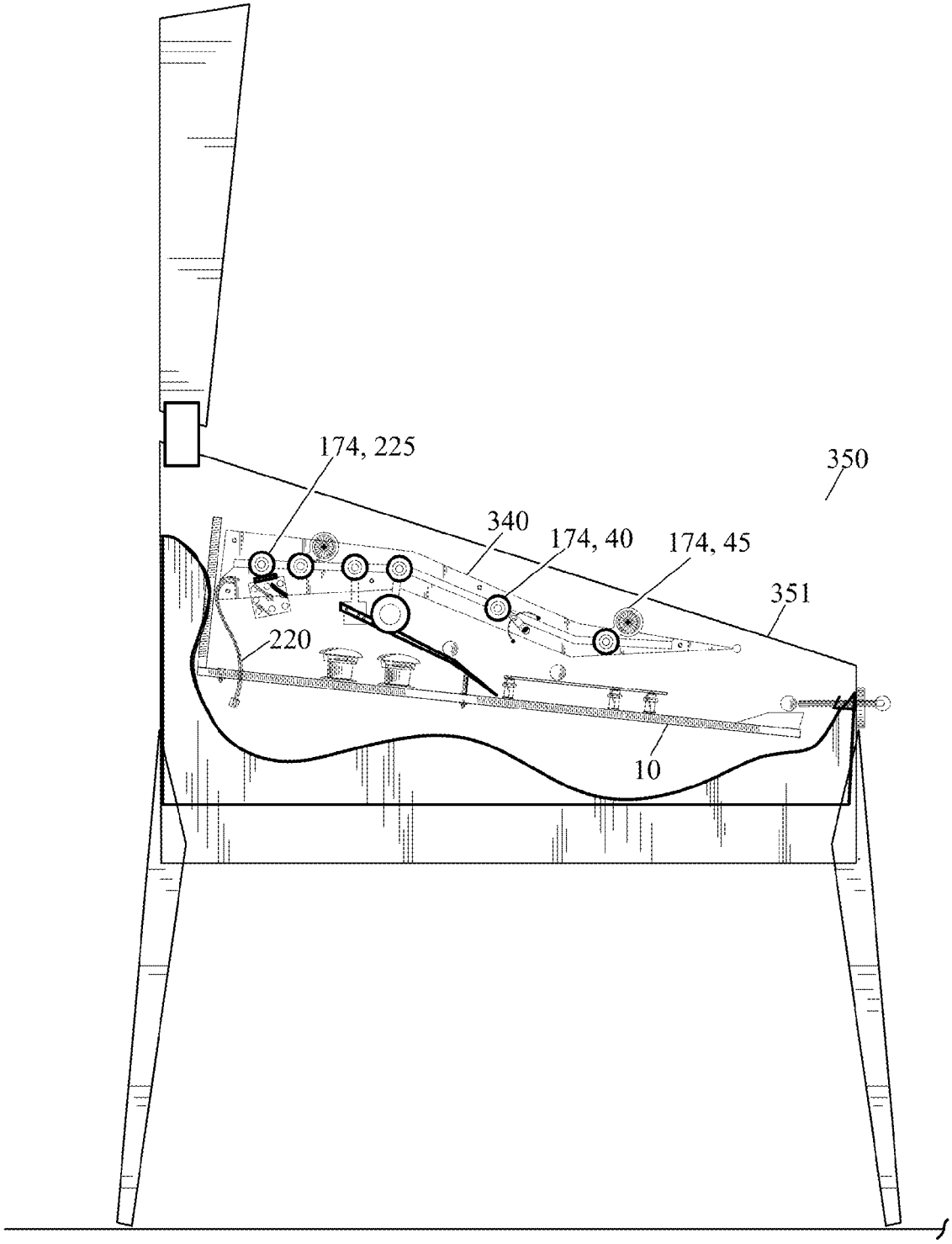
FIG. 25 shows a partial cut-away view of a game cabinet and pinball game playfield with an exemplary arrangement of an embodiment of a decorative and conductive structural element truss system installed and enabling above pinball game playfield mounting of game features.

FIG. 25 shows a partial cut-away of a complete pinball machine 350 with a pinball game playfield 10, and a truss structural element 340 mounted in a vertical plane on the pinball game cabinet 351. As described in with regard to FIG. 23, the truss structural element 340 in FIG. 25 is both structural and conductive, and also has a decorative form. Hence, any of the attachment modules 170, 172, 173, 174, 260, 260A described herein may be employed in this configuration as well. The truss structural element 340 may also, for example, include conventional wires 220 for connection to a programmable truss controller 55. Attached to the truss structural element 340 through attachment modules 174 are: a diffuser 45 with a lamp, a spot light 40, and an LED array 225. While single plane views of the truss structural element 340 have been shown in FIGS. 23-25, and elsewhere herein, this should not be considered a limitation of the truss structural elements 20, 340, and truss structural elements 20, 340 of any geometry may be implemented according to the present invention with appropriate modifications to the truss system described herein.

FIG. 26 shows an embodiment of a truss structural element 20 holding a transparent hollow plastic tube 360 containing a linear LED array 365 forming a linear LED array lighting feature 370. In this embodiment, a single truss structural element 20 is shown connected to an attachment module 260 secured by a thumb screw 261. However, as in other embodiments described herein, the linear LED array lighting feature 370 may be alternatively supported by any of the truss structural element 20 configurations and attachment module 170, 172, 173, 174, 260, 260A embodiments described herein. The attachment module 260 in this embodiment also has a support 375 with an aperture 380 through which the linear LED array 370 lighting feature passes and is secured by, for example, thumb screws 261, other types of fasteners, a clip on aperture 380 configuration, adhesives, or other fasteners. The linear LED array 365 is powered and/or controlled, for example, by conventional wires 220, ribbon conductors 221, or any of the attachment modules 170, 172, 173, 174, 260, 260A described herein.

Alternatively, the linear LED array 370 lighting feature is configured as a truss structural element 20, with appropriate modification to attachment modules 170, 172, 173, 174, 260, 260A, truss spacers 200, and other truss system elements described herein to accept the cross sectional profile of the linear LED array 370 lighting feature. Conductors may be added to an external surface of the linear LED array 370 lighting feature by any means know in the art to support functionality of pinball game features supported by the linear LED array 370 lighting feature used as a truss structural element 20. Appropriate modification to conductors and contacts used in the attachment modules 170, 172, 173, 174, 260, 260A and other truss system elements described herein to mate to a conductor arrangement on the linear LED array 370 lighting feature used as a truss structural element 20 may also be made. Further, a linear LED array 370 lighting feature used as a truss structural element 20 may be also combined with any combination of additional truss structural elements 20, 340 described herein. While the linear LED array 370 lighting feature shown in this embodiment has a substantially square cross sectional profile, any cross sectional profile use in the construction of the LED array lighting feature 370 may be used.

In addition to the examples discussed herein, the truss system elements and/or pinball game features may vary in many features, including, but not limited to, size, color, shape and style. In some embodiments, custom truss system elements or other pinball game feature elements may be made using 3D printer technology. In other embodiments, the structure may include one or more of the following: cut shapes, decorative elements, or laser cut steel to hold truss system elements, or conduct electricity to control and power points, sensors, or other electrical or electronic elements that are part of, or interface with, the truss system described herein.

In some embodiments, game owners are provided with customizable control files that drive 3D printers. Hence, a user may, for example, take a basic truss post 25 pattern, and modify its surface features, color, length, and other post geometries without deviating from the fundamental truss post 25 structure, function, and truss system element interfacing described herein. Similarly, 3D printer control files may be modified to print game owner specific custom modifications to attachment modules 170, 172, 173, 174, 260, 260A, truss spacers 200, truss structural elements 20, 340, connector blocks 30A, 30B, and other truss system elements without deviating from the respective structural basis and inter-connectivity of the truss system elements described herein.

In some embodiments, development kits including conductor strips or other types of conductor arrangements, contacts, springs, or other truss system element components are provided for incorporation into custom 3D printed truss system elements during printing, or after printing, for example. The truss system described herein also facilitates the manufacture of pinball game kits, in which all necessary parts are shipped unassembled, with truss system specific hardware and 3D printer control files, so that hobbyists and professionals may construct their own version of a given pinball game title in conjunction with 3D printers known in the art.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A truss system for a pinball game having a playfield, a cabinet, and a game control system, the truss system comprising:

at least one truss having at least one structural element with a first end and a second end;

at least one post having a first end and a second end, the second end of the at least one post for attachment to the pinball game;

at least one truss connector connecting the at least one post to the at least one structural element of the truss proximal to the first end of the at least one post; and at least one attachment module removably attached to the at least one truss, the at least one attachment module also being attached to at least one pinball game feature, the at least one pinball game feature being supported by the attachment module attached to the truss, the at least one truss including a plurality of electrically conductive structural members, the attachment module including contacts that mate to the plurality of conductive structural members, the contacts also being electrically connected to the at least one pinball game feature attached to the attachment module.

2. The truss system of claim 1, wherein the second end of the post is attached to the pinball game by engaging threads in the second end of the post onto a threaded stud on the pinball game.

3. The truss system of claim 1, wherein the post defines a hollow tube, and the post is attached to the pinball game by a threaded screw passing from the first end of the post, through the hollow tube, out the second end of the post, and into the pinball game.

4. The truss system of claim 1, wherein the post is attached to the pinball game by a post socket on the pinball game engaging with the second end of the post.

5. The truss system of claim 1, wherein the at least one truss connector comprises a post collar with an aperture for receiving a post, rotatably connected to a truss collar with at least one aperture for receiving at least one structural element of the truss.

6. The truss system of claim 1, wherein the attachment module comprises a socket connected to the contacts of the attachment module, and the at least one pinball game feature attached to the attachment module comprises a plug that mates to the socket of the attachment module.

7. The truss system of claim 1, wherein the truss system further comprises a programmable truss controller having a processor with a non-transient memory, at least one control interface connected to the plurality of electrically conductive structural members, and a connection to a power source.

8. The truss system of claim 7, wherein the programmable truss controller comprises a programmable network node interface and control software, and the attachment module comprises an addressable network node.

9. The truss system of claim 8, wherein the programmable network node interface and the addressable network node are connected wirelessly.

10. The truss system of claim 7, wherein the programmable truss controller further comprises a control interface connected to at least one electro-mechanical control component of the pinball game control system.

11. The truss system of claim 7, wherein the programmable truss controller further comprises an interface connected to a pinball game feature control switch array interface of the pinball game control system.

12. The truss system of claim 1, wherein the attachment module defines a channel that partially surrounds the at least one structural member of the truss such that the attachment module snap fits to the at least one structural element of the truss.

13. The truss system of claim 1, further comprising a second playfield supported above the pinball game playfield by at least one mount support connected to the at least one structural element of the truss.

14. The truss system of claim 1, wherein the at least one pinball game feature attached to the attachment module includes any one or more features selected from the group consisting of an incandescent lamp, an LED, an electro-mechanical device, a switch, a display, and a magnet.

15. A truss system for a pinball game having a playfield, a cabinet, and a game control system, the truss system comprising:

at least one truss having at least one structural element with a first end and a second end;

at least one post having a first end and a second end, the second end of the at least one post for attachment to the pinball game;

at least one truss connector connecting the at least one post to the at least one structural element of the truss proximal to the first end of the at least one post;

at least one attachment module removably attached to the at least one truss, the at least one attachment module also being attached to at least one pinball game feature;

a mounting bus having at least one mounting channel, the pinball game including a side rail with a length adjacent to the playfield, the at least one mounting channel forming at least a portion of the length of the side rail; and at least one bus connector removably attached to the at least one mounting channel of the mounting bus and at least one of the at least one post, the at least one pinball game feature being supported by the attachment module attached to the truss.

16. The truss system of claim 15, wherein the at least one mounting channel comprises a plurality of conductors, and the at least one pinball game feature is electrically connected to the plurality of conductors by contacts in the bus connector that mate to the plurality of conductors of the at least one mounting channel.

17. The truss system of claim 16, wherein at least some of the plurality of conductors of the at least one mounting channel are electrically connected to a programmable truss controller.

18. A truss system for a pinball game having a playfield, a cabinet, and a game control system, the truss system comprising:

at least one truss having at least one structural element with a first end and a second end;

at least one post having a first end and a second end, the second end of the at least one post for attachment to the pinball game;

at least one truss connector connecting the at least one post to the at least one structural element of the truss proximal to the first end of the at least one post; and at least one attachment module removably attached to the at least one truss, the at least one attachment module also being attached to at least one pinball game feature, the at least one pinball game feature being supported by the attachment module attached to the truss, the at least one attachment module being held on the at least one structural element of the truss by a spring bias clamping the at least one structural element of the truss between a first half of the attachment module and a second half of the attachment module.

19. A truss system for a pinball game having a playfield, a cabinet, and a game control system, the truss system comprising:

at least one truss having at least one structural element with a first end and a second end;

at least one post having a first end and a second end, the second end of the at least one post for attachment to the pinball game;

at least one truss connector connecting the at least one post to the at least one structural element of the truss proximal to the first end of the at least one post; and at least one attachment module removably attached to the at least one truss, the at least one attachment module also being attached to at least one pinball game feature, the at least one pinball game feature being supported by the attachment module attached to the truss, the at least one attachment module being held on the at least one structural element of the truss by tightening a screw and clamping the at least one structural element of the truss between a first half of the attachment module and a second half of the attachment module.

* * * * *